United States Patent [19]

Wachi

[11] 4,393,742

[45] Jul. 19, 1983

[54] ELECTRONIC MUSICAL INSTRUMENTS OF THE TYPE SYNTHESIZING A PLURALITY OF PARTIAL TONE SIGNALS

[75] Inventor: Masatada Wachi, Hamamatsu, Japan

[73] Assignee: Nippon Gakki Seizo Kabushiki Kaisha, Hamamatsu, Japan

[21] Appl. No.: 292,052

[22] Filed: Aug. 12, 1981

[30] Foreign Application Priority Data

Sep. 8, 1980 [JP] Japan ..... 55-124929

[51] Int. Cl.[3] ..... G10H 1/06

[52] U.S. Cl. ..... 84/1.23; 84/1.01

[58] Field of Search ..... 84/1.01, 1.03, 1.19, 84/1.11, 1.21, 1.22, 1.23; 364/718, 721; 328/14

[56] References Cited

U.S. PATENT DOCUMENTS

| | | | |
|---|---|---|---|
| 3,809,786 | 5/1974 | Deutsch | 84/1.01 |
| 3,809,788 | 5/1974 | Deutsch | 84/1.01 |
| 4,133,242 | 1/1979 | Nagai et al. | 84/1.22 |
| 4,238,984 | 12/1980 | Watanabe | 84/1.01 |
| 4,244,257 | 1/1981 | Niimi et al. | 84/1.22 |
| 4,282,790 | 8/1981 | Wachi | 84/1.23 |

FOREIGN PATENT DOCUMENTS 55-32028 6/1980 Japan .

*Primary Examiner*—J. V. Truhe
*Assistant Examiner*—Forester W. Isen
*Attorney, Agent, or Firm*—Spensley, Horn, Jubas & Lubitz

[57] ABSTRACT

An electronic musical instrument sequentially calculates a plurality of partial tone signals which are amplitude-modulated by a plurality of time window signals, on the time division basis, such that these partial tone signals are synthesized to form a musical tone signal. The instrument includes a circuit means for producing a plurality of predetermined time window signals, an another circuit means for producing a plurality of predetermined partial tone signals and modulating means for modulating the partial tone signals with the time window signals on the time division basis. This instrument makes it possible to form a musical tone having a great number of harmonic components with a simple circuit construction.

8 Claims, 14 Drawing Figures

ELECTRONIC MUSICAL INSTRUMENTS OF THE TYPE SYNTHESIZING A PLURALITY OF PARTIAL TONE SIGNALS

BACKGROUND OF THE INVENTION

This invention relates to an electronic musical instrument, and more particularly an electronic musical instrument of the type for sequentially calculating a plurality of partial tone signals with a plurality of time divisioned time slots such that these partial tone signals are synthesized to form a musical tone signal.

A partial tone synthesizing system disclosed in U.S. Pat. Nos. 3,809,786 and 3,809,788 both issued May 7, 1974 is known as one example of an electronic musical instrument in which a plurality of partial tone components (higher harmonic components are sequentially calculated in a plurality of time divisioned time slots and the calculated partial tone components are synthesized for the purpose of forming a musical tone.

Since in the electronic musical instrument of such partial tone synthesizing system, a plurality of time divisioned time slots of the number equal to the number of the partial tone signals to be synthesized are provided and since in each time divisioned time slot only one preassigned partial tone signal is calculated, it is necessary to provide the time divisioned time slots of the same number as that of the partial tone signals to be synthesized with the result that where a musical tone producing signal containing a plurality of partial tone signals is to be formed, the number of the time divisioned time slots is increased thus increasing the size of the circuit.

As a consequence, as disclosed in Japanese Preliminary Publication of patent No. 32028 of 1980 (corresponding to U.S. Ser. No. 067,693), an electronic musical instrument has been proposed in which a window signal of a predetermined time such as a Hanning window signal is multiplied with a partial tone signal of a predetermined frequency, for example a sine wave signal, for simultaneously calculating a plurality partial tone signals in a predetermined frequency bandwidth having the frequency of a predetermined partial tone signal at the center.

Since this electronic musical instrument is constructed such that a waveform obtained by amplitude modulating a predetermined partial tone signal with a Hanning window signal is prestored in a memory device and the stored waveform is read out by an address signal having a period corresponding to the time width of the Hanning window signal, the relation between the Hanning signal and the predetermined partial tone signal would be fixed so that there is a disadvantage that it is impossible to arbitrarily set the frequency bandwidth of a plurality of partial tone signals which are calculated simultaneously.

To obviate this disadvantage one may consider a system in which different amplitude modulated waveforms are stored in a plurality of memory devices so as to selectively read out any desired waveform. With this system, however, the number of the memory devices increases, thus increasing the size of the apparatus.

SUMMARY OF THE INVENTION

It is therefore an object of this invention to provide an improved electronic musical instrument capable of forming a plurality of partial tone signals with a simple construction.

According to this invention, there is provided an electronic musical instrument comprising means for producing a time window signal, means for producing a plurality of predetermined partial tone signals, first control means connected to said time window signal producing means for controlling a time width of said time window signal, second control means connected to said partial tone signal producing means for controlling a frequency of each of said partial tone signals and assigning said partial tone signals to respective time divisioned time slots, modulating means for modulating said partial tone signals with said time window signal and producing modulated partial tone signals in said time divisioned time slots respectively, and synthesizing means connected to said modulating means for synthesizing said modulated partial tone signals and producing a musical tone signal.

According to a modified embodiment of this invention there is provided an electronic musical instrument comprising a plurality of musical tone forming channels, each of which comprises means for producing a plurality of time window signals, means for producing a plurality of predetermined partial tone signals, first control means connected to said time window signal producing means for controlling a time width of each of said time window signals and assigning said time window signals to respective time divisioned slots, second control means connected to said partial tone signal producing means for determining a frequency of each of said partial tone signals and assigning said partial tone signals to respective said time divisioned time slots, modulating means for modulating said partial tone signals with said time window signals and producing modulated partial tone signals in said time divisioned time slots respectively, and synthesizing means connected to said modulating means for synthesizing said modulated partial tone signals on the time division basis, musical tones in respective said musical tone forming channels being different each other.

BRIEF DESCRIPTION OF THE INVENTION

DESCRIPTION OF THE PREFERRED EMBODIMENT

Figure 1:
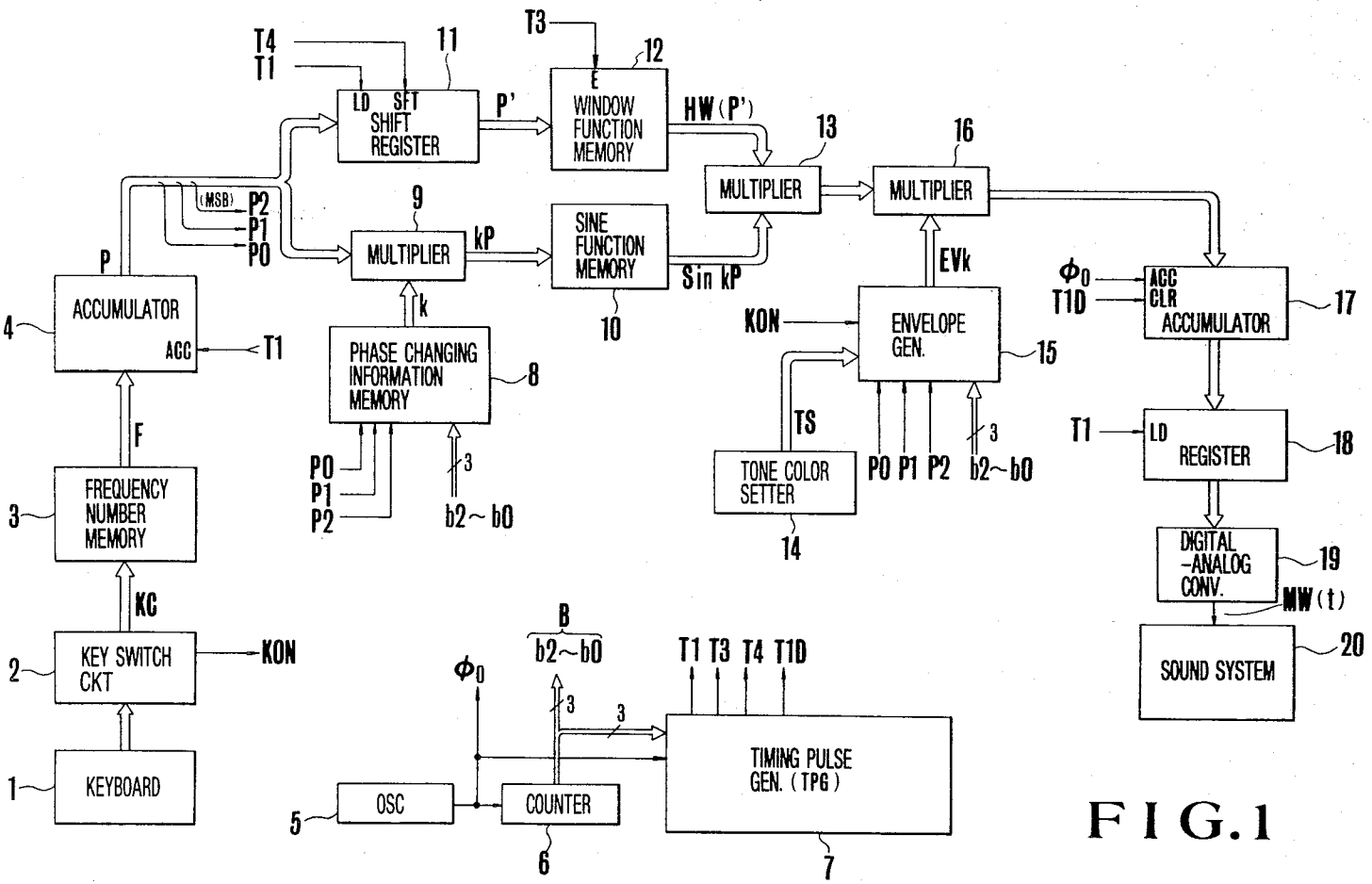
FIG. 1 is a block diagram showing one embodiment of the electronic musical instrument according to this invention.

A preferred embodiment of the electronic musical instrument embodying the invention has a basic circuit construction as shown in FIG. 1 which includes recurrent 8 time divisioned time slots ts0 through ts7 as shown in FIG. 2*a* which form partial tone signals having waveforms as shown in FIGS. 2*b* through 2*i* in one period of a musical tone signal. More particularly, a first order partial tone signal h1 (fundamental component) having a frequency f1 is formed in the time slot ts0, the second order partial tone signal h2 having a frequency of 2fl is formed in the time slot ts1, and the third order partial tone signal h3 having a frequency of 3fl is formed in the time slot ts2 in the time slot ts3, the fourth order partial tone signal h4 having a frequency of 4fl is multiplied with Hanning window signal HW having a time width WT equal to one period T of the musical tone signal to simultaneously calculate a plurality of partial tone signals h4w over a predetermined bandwidth having the fourth order partial tone signal h4 as the center component. In the time slot ts4, the sixth order partial tone signal h6 having a frequency of 6fl is multiplied with a Hanning window signal HW having a time width WT equal to one period T of the musical tone signal to simultaneously calculate a plurality of partial tone signals h6w over a predetermined bandwidth having the sixth order partial tone signal h6 as the center component. In the time slot ts5, and in the bore fore half portion of one period T of the musical tone signal, the eighth order partial tone signal h8 having a frequency of 8fl is multiplied with a Hanning window signal HW having a time width WT equal to one half of one period T of the musical tone signal [$WT=(\frac{1}{2})\times(T)$] for simultaneously producing a plurality of partial tone signals h8w over a predetermined bandwidth and having the eighth order partial tone signal h8 as the center component, while in the latter half of one period T of the musical tone signal, the 12th order partial tone signal h12 having a frequency of 12fl is multiplied with a Hanning window signal HW having a time width WT equal to one half of one period T of the musical tone signal for simultaneously forming a plurality of partial tone signals h12w over a predetermined bandwidth and having the 12th order partial tone signal h12 as the center component. In the time slot ts6, one period T of the musical tone signal is divided by 4 and in respective $\frac{1}{4}$ periods, the Hanning window signal HW having the time width WT equal to $\frac{1}{4}$ of one period T of the musical tone signal is multiplied respectively with the 16th order partial tone signal h16 having a frequency of 16fl, with the 24th order partial tone signal h24 having a frequency of 24fl, with the 32th order partial tone signal h32 having a frequency of 32fl, and with the 40th order partial tone signal h40 having a frequency of 40fl for simultaneously forming a plurality of partial tone signals h16w, h20w, h24w, h32w and h40 over predetermined bandwidths respectively having partial tone signals h16, h24, h32 and h40 has the center components. In the time slots ts7 in respective $(\frac{1}{8})\times(T)$ of the musical tone signal, a Hanning window signal HW having a time width WT equal to $\frac{1}{8}$ of one period T of the musical tone signal [$WT=(\frac{1}{8})\times(T)$] is multiplied respectively with the 48th, 64th, 80th, 96th 112th, 128th, 160th, 192th partial tone signals h48, h64, h80, h96, h112, h128, h160 and h192 having frequencies of 48fl, 64fl, 80fl, 96fl, 112fl, 128fl, 160fl and 192fl respectively for simultaneously forming a plurality of partial tone signals h48w, h64w, h80w, h96w, h112w, h128w, h160w and h192w respectively having the partial tone signals h48 through h192 as their center components. Although these partial tone signals may be sine or cosine wave signals, in the following description it is assumed that they are sine wave signals.

Figure 3:
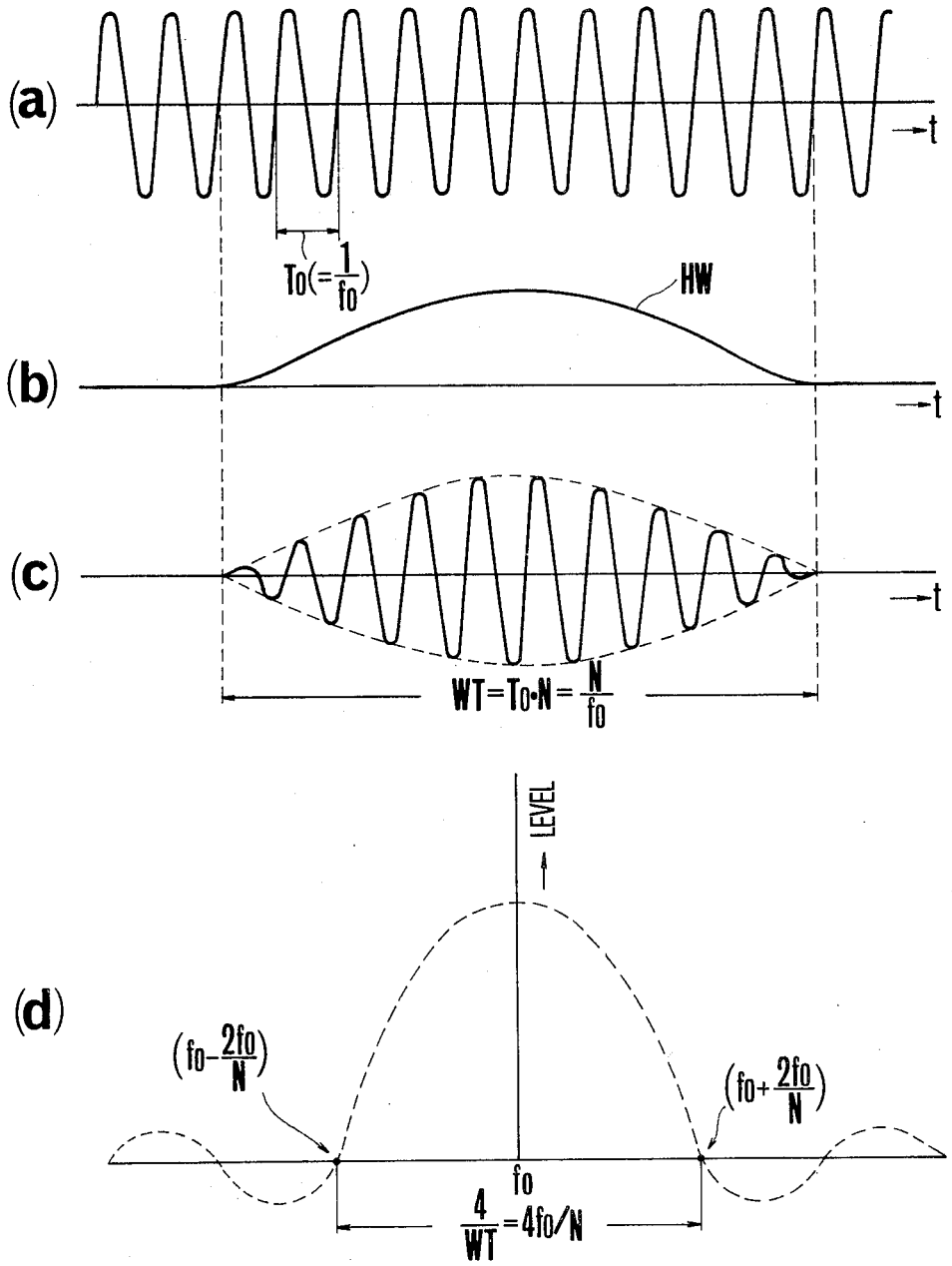
FIG. 3 shows waveforms for explaining the spectrum envelope of a partial tone signal formed by utilizing a Hanning window signal.

When a sine wave signal having a frequency of f0 as shown in FIG. 3*a* is multipled with a Hanning window signal HW having the same time width WT as that of the sine wave signal [N times of a period T0, where N is a positive integer ($WT=(T0)\times(N)=(N)/f0$] as shown in FIG. 3*b*, a waveform as shown in FIG. 3*c* would be obtained. However, as shown in FIG. 3*a*, this waveform has a spectrum envelope having a bandwidth (main lobe) expressed by 4/WT, that is $(4)\times(f0)/N$ as shown in FIG. 3*d*.

Accordingly, in the foregoing description, when it is assumed that the first order partial tone signal h1 has a frequency f1 of 100 Hz, for example, in the time slot ts3, the fourth order partial tone signal h4 having a frequency of 4fl, that is 400 Hz, would be multiplied with a Hanning window signal HW having a time width WT of T (=1/fl), that is 1/100 second, so that at f0=100 Hz, and $N=(Wt)\times(F0)=1$ a plurality of partial tone signals h4w manifesting a spectrum envelope would be formed, which has the 4th order partial tone component signal h4 (a frequency of 400 Hz) as the center component, an envelope width $M=(4)\times(400)/4=400$ Hz, a lower limit frequency $(f0-M/2)$ of 200 Hz, and a upper limit frequency $(f0+M/2)$ of 600 Hz. Since f0=600 Hz and N=6, in the time slot ts1 too, a similar calculation simultaneously produces a plurality of partial tone signals h6w manifesting a spectrum envelope having a width of $M=(4)\times(600)/6=400$ Hz, a lower limit frequency $(f0-M/2)=800$ Hz and the sixth order partial tone signal h6 (a frequency of 600 Hz) as the center component. On the other hand, in the time slot ts5, since time width WT of the Hanning window signal HW is $(\frac{1}{2})\times(T)$ ($=\frac{1}{2}\times fl$), in the fore half portion, f0=800 Hz, while N=4 whereas in the later half portion f0=1200 Hz and N=6. For this reason, in the fore half portion of the time slot ts5, a plurality of partial tone signals h8w are produced which manifest on spectrum envelope having a width $M=(4)\times(800)/4=800$ Hz, a lower limit frequency $(f0-M/2)=400$ Hz, a upper limit frequency $(f0+M/2)=1200$ Hz and has the 8th order partial tone signal h8 (a frequency of 800 Hz) as the center component, whereas in the later half portion, a plurality of partial tone signals h12w are obtained which manifest a spectrum envelope having a width $M=(4)\times(1200)=800$ Hz, a lower limit frequency $(f0-M/2)=800$ Hz, an upper limit frequency $(f0+M/2)=1600$ Hz and has the 12th order partial tone signal h12 (a frequency of 1200 Hz) as the center component. In the time slot ts6, since the time width TW of the Hanning window signal HW is $(\frac{1}{4})\times(T)$ ($=\frac{1}{4}\times fl$)

the frequencies f0 of respective partial tone signals h16, h24, h32 and h40 becomes 1600 Hz, 3200 Hz, and 4000 Hz respectively, while N becomes 4, 6, 8 and 10 respectively. Consequently, the main lobe width M, the lower limit frequency (f0−M/2) and the upper limit frequency (f0+M/2) of a spectrum envelope of signals h16w, h24w, h32w and h40w respectively having the 16th order partial tone signal h16, the 24th order partial tone signal h24, the 32th order partial tone signal h32, and the 40th order partial tone signal h40 as their center components are expressed as follows.

| | |
|---|---|
| h16w - M = 4 × 1600/4 = | 1600 Hz |
| (f0 − M/2) = | 800 Hz |
| (f0 + M/2) = | 2400 Hz |
| h24w - M = 4 × 2400/6 = | 1600 Hz |
| (f0 − M/2) = | 1600 Hz |
| (f0 + M/2) = | 3200 Hz |
| h32w - M = 4 × 3200/8 = | 1600 Hz |
| (f0 − M/2) = | 2400 Hz |
| (f0 + M/2) = | 4000 Hz |
| h40w - M = 4 × 4000/10 = | 1600 Hz |
| (f0 − M/2) = | 3200 Hz |
| (f0 + M/2) = | 4800 Hz |

also, since in the time slot ts7, the time width WT of the Hanning window signal HW is $(\frac{1}{8})\times(T)$ $(=\frac{1}{8}\times fl)$, the frequencies f0 regarding respective partial tone signals h48, h64, h80, h96, h112, h128, h160 and h192 having frequencies of 48fl, 64fl, 80fl, 96fl, 112fl, 128fl, 160fl, 192fl become 4800 Hz, 6400 Hz, 8000 Hz, 9600 Hz, 11200 Hz, 12800 Hz, 14400 Hz, 19200 Hz respectively, while N becomes 6, 8, 10, 12, 14, 16, 20 and 24 respectively. Consequently, the main lobe width M, the lower limit frequency (f0−M/2), the upper limit frequency (f0+M/2) and a spectrum envelope of signals h48w, h64w, h80w, h94w, h112w, h128w, h160w and h192w respectively having the 18th order through 192th partial tone signals h48, h64, h96, h112, h128, h160, and h192 as their center components are expressed as follows.

| | |
|---|---|
| h48w - M = 4 × 4800/6 = | 3200 Hz |
| (f0 − M/2) = | 3200 Hz |
| (f0 + M/2) = | 5400 Hz |
| h64w - M = 4 × 6400/8 = | 3200 Hz |
| (f0 − M/2) = | 5200 Hz |
| (f0 + M/2) = | 8000 Hz |
| h80w - M = 4 × 8000/10 = | 3200 Hz |
| (f0 − M/2) = | 6400 Hz |
| (f0 + M/2) = | 9600 Hz |
| h96w - M = 4 × 9600/12 = | 3200 Hz |
| (f0 − M/2) = | 8000 Hz |
| (f0 + M/2) = | 11200 Hz |
| h112w - M = 4 × 11200/14 = | 3200 Hz |
| (f0 − M/2) = | 9600 Hz |
| (f0 + M/2) = | 12800 Hz |
| h128w - M = 4 × 12800/16 = | 3200 Hz |
| (f0 − M/2) = | 11200 Hz |
| (f0 + M/2) = | 14400 Hz |
| h160w - M = 4 × 16000/20 = | 3200 Hz |
| (f0 − M/2) = | 14400 Hz |
| (f0 + M/2) = | 17600 Hz |
| h192w - M = 4 × 19200/24 = | 3200 Hz |
| (f0 − M/2) = | 17600 Hz |
| (f0 + M/2) = | 20800 Hz |

Figure 4:
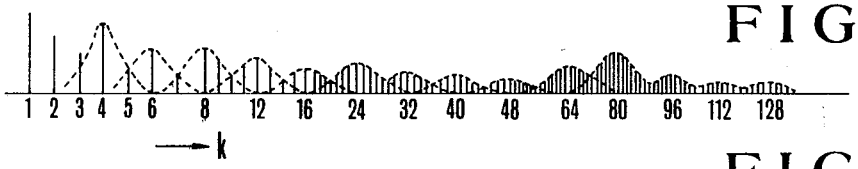
FIG. 4 shows the spectrum envelope of a musical tone signal formed by the electronic musical instrument shown in FIG. 1.

Consequently, the spectrum envelope of all partial tone signals formed in time slots ts0 through ts7 is shown in FIG. 4 in which the abscissa represents the order numbers k of the partial tone signals.

As above described, the electronic musical instrument shown in FIG. 1 operates to calculate a plurality of partial tone components over a wide bandwidth as shown by the spectrum envelope shown in FIG. 4 in eight time divisioned time slots ts0 through ts7. The time widths of the Hanning window signals HW produced in time slots ts5, ts6 and ts7 have time width $\frac{1}{2}$ times, $\frac{1}{4}$ times and $\frac{1}{8}$ times of those of the Hanning window signals produced in time slots ts3 and ts4 respectively. It is to be noted, however, that all the time widths WT of the Hanning window signals in the same time slot are the same. For this reason, in order to generate a plurality of Hanning window signals having different time widths WT from the same memory circuit, for example, it is necessary to control the speed of varying the memory read out address signal in accordance with the time width WT of a Hanning window signal HW to be produced in a specific time slot. Where the speed of varying the address signals for time slots ts3 and ts4 is denoted by "1" those of the address signals for the time slots ts5, ts6 and ts7 would be "2" "4" and "8" respectively.

The circuit construction of the electronic musical instrument shown in FIG. 1 will now be described.

Thus, it comprises a keyboard 1; a key switch circuit 2 including a plurality key switches corresponding to respective keys of the keyboard 1 arranged such that upon depression of a key, a key switch corresponding thereto is operated to produce a key code KC corresponding to the depressed key and a key-on signal KON representing that a certain key has been depressed; a frequency number memory device 3 which stores frequency numbers F corresponding to the tone pitches of respective keys in respective addresses of the memory device so that as a key code KC is applied to act as an address signal from the key switch circuit 2 a frequency number F corresponding to the tone pitch of the depressed key would be outputted; and an accumulator 4 which repeatedly accumulates the frequency number F each time the time pulse T1 is generated so as to produce its accumulated value qF (q=1, 2, 3 . . . ) as a phase designation signal P that designates the sampling point phase in one period of a musical tone signal. The value of the phase designation signal P produced from the accumulator 4 repeatedly varies with a period corresponding to the tone pitch of the depressed key, in other words with the period of a musical tone signal to be produced so that the most significant bit order signal P2 of the phase designation signal P is "0" in the fore half portion of one period, while "1" in the later half portion. Signals P1 and P0 of the bits next and following bit of the most significant bit repeatedly become "0" and "1" respectively with periods of $\frac{1}{2}$ and $\frac{1}{4}$ respectively of that of the signal P2. These signals P2, P1 and P0 are used to judge the phase position of one period of the musical tone signal.

Figure 5:
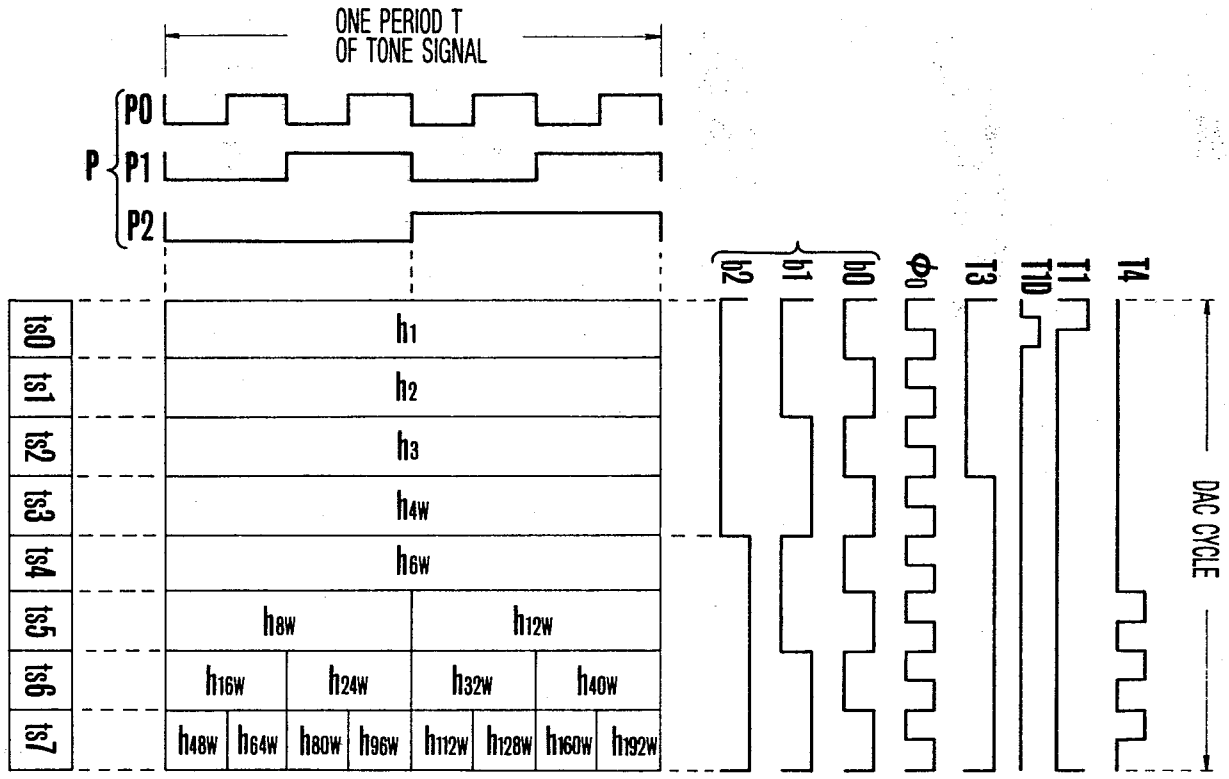
FIG. 5 is a diagram showing the phase relationship between respective partial tone signals formed by the electronic musical instrument shown in FIG. 1 and one period of the musical tone signal and the time relation of the timing pulse.

There are also provided an oscillator 5 for producing a clock pulse $\phi$0 of a predetermined frequency; a counter 6 which counts the number of clock pulses $\phi$0 for producing a slot number signal comprising three bit signals b2, b1 and b0 respectively representing the time divisioned time slots ts0 through ts7 and a timing signal generator 7 which generates various timing pulses T1, T3, T4 and T1D necessary for calculating predetermined partial tone signals in the time slots s0 through ts7 based on the clock pulse $\phi$0 and the slot number signals b2, b1 and b0. FIG. 5 shows the relationship among the clock pulse $\phi$0, the timing pulses T1, T3 and T4, the slot number signals b2, b1 and b0, and the time slots ts0 through ts7, as well as the relationship among one period of the musical tone signal, the phase designation signals P (P2, P1 and P0), and the partial tone signals (h1, h2, h3, h4w, h6w, h8w, h12w, h16w, h24w . . . h192w) calculated in respective time slots ts0 to ts7 wherein a period in which the time slots ts0 through ts7 make one cycle is set to be equal to a DAC cycle in which the calculated partial tone signals are synthesized into the instantaneous value MW(t) of a corresponding analogue musical tone signal.

Figure 6:
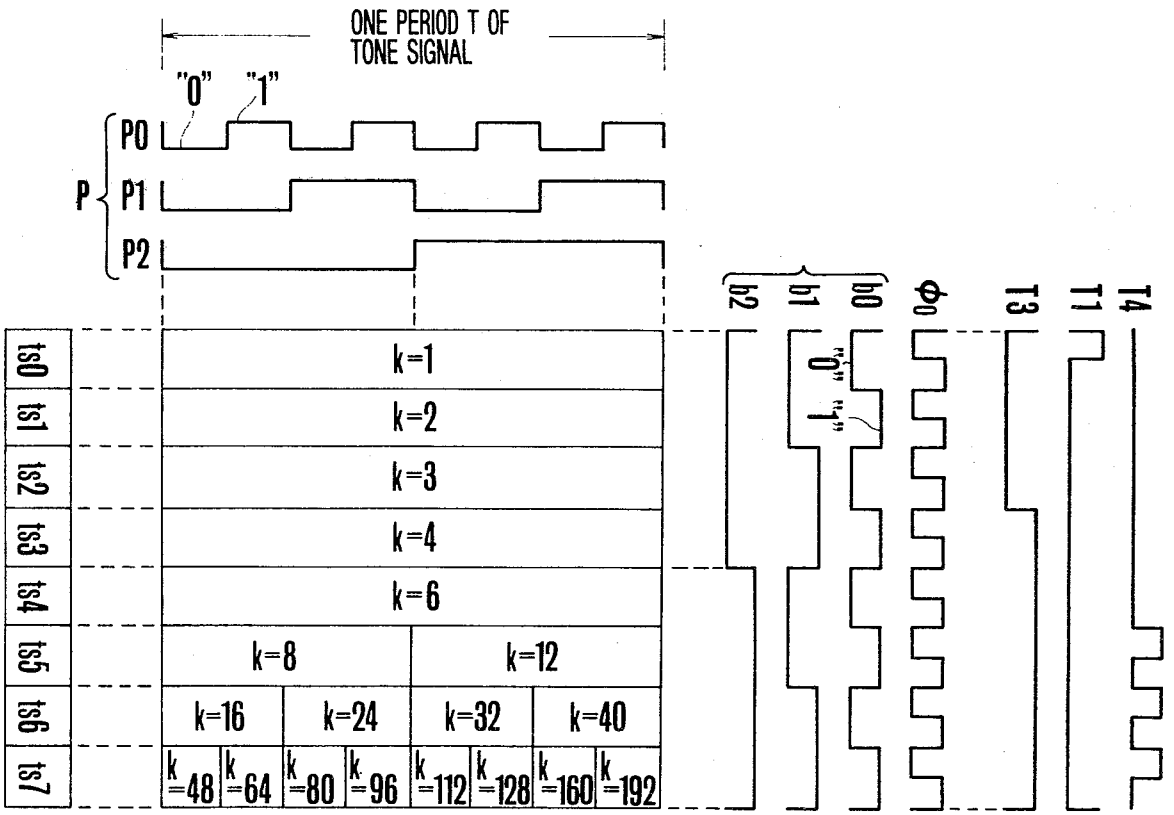
FIG. 6 is a graph showing the time relation between a phase change information and the timing pulse.

A pulse changing information memory device 8 is provided for producing a phase changing information k based on the upper order 3 bit signals P2, P1 and P0 of the phase designation signal P, the phase changing information k changing the phase designation signal P in accordance with the frequencies of the partial tone signals to be calculated in respective time slots ts0 through ts7. FIG. 6 shows the content k of the memory device 8 in relation to the signals P2, P1 and P0 and signals b2, b1 and b0. According where P2="0", P1="0" and P0="0" (which designate the first portion obtained by dividing one period T of the musical tone signal into 8 portions), and b2="1", b1="0" and b0="0" (which designate the slot time ts4) of the slot number signals b2, b1 and b0 are given, a phase modifying information k=6 would be outputted. A multiplier 9 is provided to multiply the phase designation signal P with the phase changing information k, thus producing a product kP as a partial tone phase designation signal kP corresponding to the frequency of the partial tone signal to be calculated. There is also provided a sine function memory device 10 storing in its respective addresses the sine amplitude values at respective sampling points of one period of a sine wave, and when supplied with a partial tone phase designation signal kP from the multiplier 9 as an address signal a sine amplitude value sin kP which has been stored in an address designated by the signal kP is produced.

Figure 2:
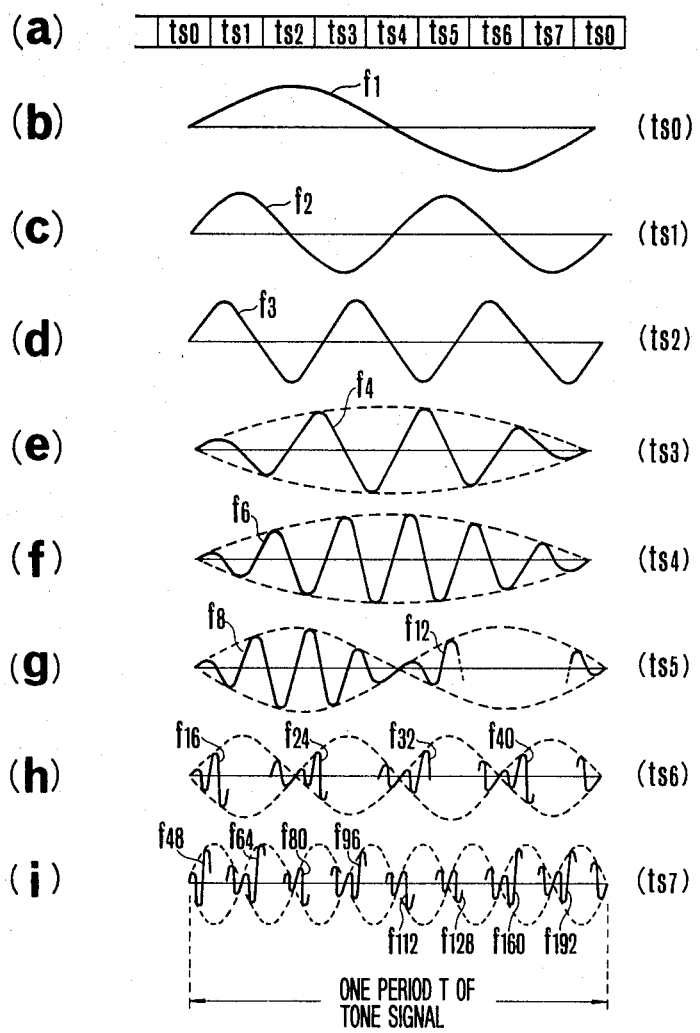
FIG. 2 shows waveforms of the partial tone signals formed in respective time slots of the electronic musical instrument shown in FIG. 1.

A shift register 11 is provided which takes into (or loaded with) a phase designation signal P in accordance with a timing pulse T1 (see FIG. 5) generated in the early stage of a DAC cycle and then shifts one bit the loaded phase designation signal P towards the upper bit each time a timing pulse T4 is generated for converting the signal P into a window phase designation signal P' necessary to generate a Hanning window signal HW having a predetermined time width WT=(T), $(\frac{1}{2})\times(T)$, $(\frac{1}{4})\times(T)$, $[(\frac{1}{8})\times(T)]$. A window function memory device 12 is provided which stores in its respective addresses the window signal amplitude values at respective sampling points of a Hanning window signal HW as shown in FIG. 3*b* and is enabled only during an interval in which the timing pulse T3 (see FIG. 5) is "1" that is during an interval between time slots ts3 through ts7 for producing a window signal amplitude value HW (P') stored in an address designated by the window phase designation signal P' applied from the shift register 11 to act as an address signal. When disabled (when the timing pulse T3 is "0") the window function memory device 12 outputs a window signal amplitude value HW (P') having a value of "1". A multiplier 13 multiplies a sine ampplitude value sin kP outputted from the sine function memory device 10 and the window signal amplitude value HW (P') outputted from the window function memory device 12 for producing partial tone signals having waveforms as shown in FIGS. 2*b* through 2, a tone color setter 14 is provided for setting the tone color of a musical tone to be produced, thus producing a tone color setting signal TS corresponding to the set tone color. There are also provided an envelope generator 15 which produces an envelope signal EVk for imparting an amplitude envelope for the partial tone signals calculated in respective time slots ts0 through ts7, based on the phase designatio signals P2, P1 and P0, the slot number signals b2, b1 and b0, the tone color setting signal Ts and the key-on signal KON; a multiplier 16 which multiplies the partial tone signal HW(P')×(sin kp) outputted from the multiplier 16 in each of the time slots ts0 through ts7 with the envelope signal EVK outputted from the envelope generator 15; and an accumulator 17 which accumulates the partial tone signal (EVk)×HW(P')×(sin kP) of each of time slots ts0 through ts7 outputted from the multiplier 16 at each DAC cycle, each time the clock pulse $\phi 0$ builds up, and the content of the accumulator 17 is reset by a timing pulse T1D slightly later than the timing pulse T1. An accumulated value (sum of the partial tone signals) Σ(EVk)×HW(P')×(sin kP) outputted from the accumulator 17 in each DAC cycle is loaded in a register 18 by the timing action of the timing pulse T1, and the output (EVk)×HW(P')×(sin kP) of the register 18 is converted into an analogue instant value MW(t) of a corresponding musical tone signal by a digital-analogue converter 19 and then supplied to a sound system 20.

The operation of the electronic musical instrument described above will be described in the following.

After closure of a source switch, not shown, the counter 6 and the timing pulse generator 7 produce slot number signals b2 through b0 and timing pulses T1, T3, T4 and T1D as shown in FIG. 5. Under this state when a performer depresses a key of the keyboard 1 after setting a desired tone color with the tone color setter 14, a frequency number F corresponding to the tone pitch of the depressed key would be read out from the frequency number memory device 3. Then the accumulator 4 sequentially accumulates the frequency number F in each DAC cycle in accordance with the timing pulse T1 to form accumulated values 1F, 2F, 3F . . . qF, and the accumulated value qF is produced as a phase designation signal P representing a sampling point phases in one period T of the musical tone signal to be produced. The phase designation signal P is applied to the phase changing information memory device 8 whose upper order 3 bits P2, P1 and P0 represent respective phase portions obtained by dividing one period T of the musical tone signal to be formed into 8 portions, with the result that the phase changing information memory device 8 outputs phase changing information k (see FIG. 6) corresponding to the partial tone signals to be calculated in respective time slots ts0 through ts7 in respective phase portions obtained by deviding one period T of the musical tone signal with 8. These phase modifying informations k are applied to the multiplier 9 to be multiplied with the phase designation signal P. Thus, the multiplier 9 outputs partial phase designation signals kP (=kqF) having the recurrent frequency same as the frequencies of the partial tone signals to be calculated in respective time slots ts0 through ts7. More particulary, the multiplier 9 produces the partial tone phase designation signals kP from respective time slots ts0 through ts7 as shown in the following Table 1 in which f1 represents the fundamental frequency (f1=1/T) of the musical tone signal to be produced.

TABLE I

| phase portion | | | recurrent frequency of signal kP time slot | | | | | | | |
|---|---|---|---|---|---|---|---|---|---|---|
| P2 | P1 | P0 | ts 0 | ts 1 | ts 2 | ts 3 | ts 4 | ts 5 | ts 6 | ts 7 |
| 0 | 0 | 0 | 1f1 | 2f1 | 3f1 | 4f1 | 6f1 | 8f1 | 16f1 | 48f1 |
| 0 | 0 | 1 | ↓ | ↓ | ↓ | ↓ | ↓ | ↓ | 16f1 | 64f1 |
| 0 | 1 | 0 | ↓ | ↓ | ↓ | ↓ | ↓ | ↑ | 24f1 | 80f1 |
| 0 | 1 | 1 | ↓ | ↓ | ↓ | ↓ | ↓ | 8f1 | 24f1 | 96f1 |
| 1 | 0 | 0 | ↑ | ↑ | ↑ | ↑ | ↑ | 12f1 | 32f1 | 112f1 |
| 1 | 0 | 1 | ↑ | ↑ | ↑ | ↑ | ↑ | ↓ | 32f1 | 128f1 |
| 1 | 1 | 0 | ↑ | ↑ | ↑ | ↑ | ↑ | ↑ | 40f1 | 160f1 |
| 1 | 1 | 1 | 1f1 | 2f1 | 3f1 | 4f1 | 6f1 | 12f1 | 40f1 | 192f1 |

As a consequence, in each one of the time slots ts0 through ts7, the sine function memory device 10 produces the sine amplitude value sin kP of a partial tone signal having the same frequency as the recurrent frequency of the partial tone phase designation signal kP.

On the other hand, the shift register 11 stores a phase designation signal P generated by the accumulator 4 according to a timing phase T1 and then outputs the signal P as a window phase designation signal P'. The signal P loaded in the shift register 11 according to the timing pulse T1 is shifted toward upper order bits each time a timing pulse T4 is generated. For this reason, in time slots ts0 through ts4, the shift register 11 outputs the signal P as the signal P' as it is, whereas in time slot ts5, signal 2P (twice of the signal P) is outputted as the signal P' and in time slot ts6, signal 4P (four times of signal P) is outputted as the signal P'. In the same manner, in the time slot ts7, a signal 8P (8 times of the signal P) is outputted as the signal P'. As above described, the shift register 11 produces, in the time slots ts0 through ts4, a window phase designation signal P' having the same recurrent period of the most significant bit signal as one period T of the musical tone signal, while in the time slot $t_{s5}$, produces a window phase designation signal P', the recurrent period of its most significant bit signal being equal to T/2, and in the time slot ts6 produces a window phase designation signal P', the recurrent period of its most significant bit being equal to T/4. Similarly, in the time slots ts7, the shift register 11 produces a window phase designation signal P', the recurrent period of its most significant bit signal being equal to T/8. The phase designation signal P' is applied to the window function memory device 12 as a signal that designates the phase of the Hanning window signal HW as shown in FIG. 3*b*. However, as above described, since the window function memory device 12 is enabled only in the time slots ts3 through ts7 in which the timing pulse T3 becomes "1", it produces a Hanning window signal HW (P') having a value of "1" in the time slots ts0 through ts2, and a Hanning window signal HW(P') having a time width WT corresponding to signal P' in the time slots ts3 through ts7. Thus, in the time slots ts3 through ts4, a Hanning window signal HW(P') having a time width WT corresponding to one period T of the musical tone signal is produced whereas in the time slot ts5, a Hanning window signal HW(P') having the time width WT of T/2 is produced, in time slot ts6, a Hanning window signal HW(P') having a time width WT of T/4 is produced, and in the time slot ts7, a Hanning window signal HW(P') having a time width WT of T/8 is produced.

The sine amplitude value sin kP of the partial tone signal thus formed is multiplied with the Hanning window signal HW(P') in the multiplier 13 so that it produces the partial tone signal amplitude values [HW(P')]×(xin kP] having waveforms as shown in FIGS. 2*b* through 2*i* in the time slots ts0 through ts7. These partial tone signal values [HW(P')]×(sin kP) are respectively multiplied with an envelope waveform signal EVk corresponding to a desired tone color in the multiplier 16 to impart an amplitude envelope for each partial tone. Thereafter, in the accumulator 17, partial tone signals (EVk)×[HW(P')]×(sin kP) calculated in respective time slots ts0 through ts7 on one DAC cycle are synthesized and the synthesized partial tone signal Σ(EVk)×[HW(P')]×(sin kP) is supplied to the digital-analogue convertor 19 via the register 18 to be converted into a corresponding analogue musical tone signal instantaneous value MW(t) which is supplied to the sound system 20. As a consequence, the sound system 20 produces a musical tone having a frequency corresponding to the tone pitch of the depressed key and a spectrum envelope as shown in FIG. 4.

The detail of the phase changing information memory device 8 and the envelope generator 15 will now be described.

As can be noted from FIG. 6, the phase changing information memory device 8 is supplied with an address signal having a total of 6 bits including upper order 3 bit signals P2, P1 and P0 of the phase designation signal P and a slot number signal (b2, b1 and b0). Accordingly, when it is assumed that the phase changing information k has 8 bits, the phase changing information memory device 8 has a memory capacity of 512 bits ($2^6 \times 8$), and phase adjusting informations k (k=1, k=2, . . . k=192) as shown in the following Table II are stored in 64 ($2^6$) addresses of the memory device 8.

TABLE II

| address input | | | | | | | |
|---|---|---|---|---|---|---|---|
| b2 | b1 | b0 | P2 | P1 | P0 | k | time slot |
| 0 | 0 | 0 | — | — | — | 1 | ts0 |
| 0 | 0 | 1 | — | — | — | 2 | ts1 |
| 0 | 1 | 0 | — | — | — | 3 | ts2 |
| 0 | 1 | 1 | — | — | — | 4 | ts3 |
| 1 | 0 | 0 | — | — | — | 6 | ts4 |
| 1 | 0 | 1 | 0 | — | — | 8 | ts5 |
| 1 | 0 | 1 | 1 | — | — | 12 | |
| 1 | 1 | 0 | 0 | 0 | — | 16 | |
| 1 | 1 | 0 | 0 | 1 | — | 24 | ts6 |
| 1 | 1 | 0 | 1 | 0 | — | 32 | |
| 1 | 1 | 0 | 1 | 1 | — | 40 | |
| 1 | 1 | 1 | 0 | 0 | 0 | 48 | |
| 1 | 1 | 1 | 0 | 0 | 1 | 64 | |
| 1 | 1 | 1 | 0 | 1 | 0 | 80 | |
| 1 | 1 | 1 | 0 | 1 | 1 | 96 | ts7 |
| 1 | 1 | 1 | 1 | 0 | 0 | 112 | |
| 1 | 1 | 1 | 1 | 0 | 1 | 128 | |
| 1 | 1 | 1 | 1 | 1 | 0 | 160 | |
| 1 | 1 | 1 | 1 | 1 | 1 | 192 | |

As can be noted from Table II, the number of types of the phase changing informations k necessary for the embodiment shown in FIG. 1 is 19. In order to store such 19 types of the phase changing informations k, memory positions formed by $2^5$(=32) addresses are necessary.

Figure 7:
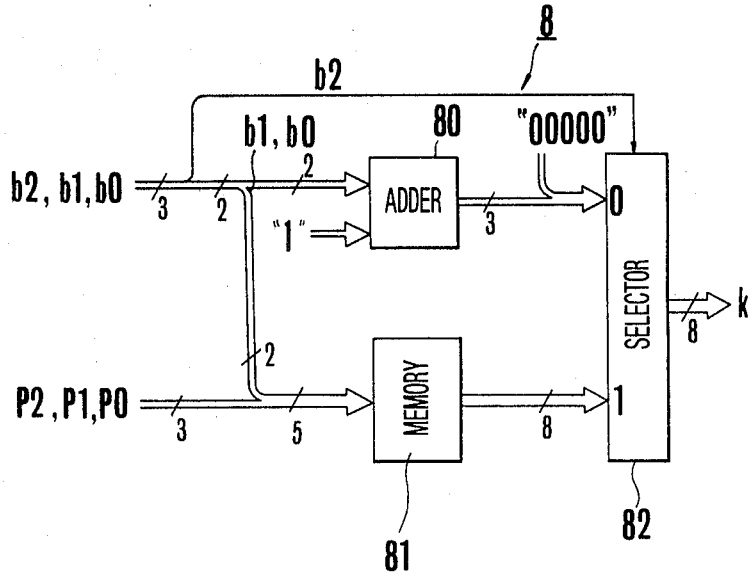
FIGS. 7, 8 and 9 are connection diagrams showing one example of the detailed construction of a phase change memory device.

FIG. 7 shows the detail of a phase changing information memory device 8 designated on the basis of such consideration, and comprising an adder 80, a first memory device 81 and a selector 82.

The adder 80 is provided in view of the fact that the phase changing informations k (where k=1 through 4) can be obtained by adding "1" to values represented by the lower order 2 bit signals b1 and b0 of the slot number signals b2, b1 and b0, and the 3 bit phase changing informations k (where k=1 through 4) produced by the adder 80 are normally added with 5 bits of "00000" to their upper bits and then applied to the "0" input of the selector 82. The phase changing informations k (where k=1 to 4) applied to the "0" input of the selector 82 are selected by and outputted from the selector 82 only when the most significant bit signals b2 of the slot number signals b2, b1 and b0 are "0".

The first memory device 81 has a total of 5 bit address inputs consisting of signals P2, P1 and P0, and signals b1 and b0 and in its respective addresses of $2^6$ are stored the phase changing informations k (8 bits) in which k=6 through k=192, as shown in the following Table III.

TABLE III

| address input | | | | | |
|---|---|---|---|---|---|
| b1 | b0 | P2 | P1 | P0 | k |
| 0 | 0 | — | — | — | 6 |
| 0 | 1 | 0 | — | — | 8 |
| 0 | 1 | 1 | — | — | 12 |
| 1 | 0 | 0 | 0 | — | 16 |
| 1 | 0 | 0 | 1 | — | 24 |
| 1 | 0 | 1 | 0 | — | 32 |
| 1 | 0 | 1 | 1 | — | 40 |
| 1 | 1 | 0 | 0 | 0 | 48 |
| 1 | 1 | 0 | 0 | 1 | 64 |
| 1 | 1 | 0 | 1 | 0 | 80 |
| 1 | 1 | 0 | 1 | 1 | 96 |
| 1 | 1 | 1 | 0 | 0 | 112 |
| 1 | 1 | 1 | 0 | 1 | 128 |
| 1 | 1 | 1 | 1 | 0 | 160 |
| 1 | 1 | 1 | 1 | 1 | 192 |

Accordingly, when 5 bit address input signals b1, b0, P2, P1 and P0 are inputted to the first memory device 81, phase changing informations k (k=6, . . . 192) corresponding to these address input signals are read out. The 8 bit phase changing informations k thus read out are applied to the "1" input of the selector 82 and selected by and outputted therefrom only when the signal b2 shows a binary value "0". With this construction, it is possible to output 19 types of the phase changing informations k by using a memory device having a capacity of 256 bits ($2^5 \times 8$).

This memory capacity is more than twice of an ideal memory capacity 19×8. Accordingly, it is advantageous to constitute the first memory device 81 with a code converter 810 and a second memory device 811 as shown in FIG. 8 for converting values represented by signals b1, b0, P2, P1 and P0 into four bit signals a3, a2, a1 and a0 as shown in the following Table IV with the code converter 810 so as to read out 15 types of the phase changing informations k from the second memory device 811 by using these 4 bit signals a3 through a0.

TABLE IV

| code converter input | | | | | code converter output | | | | |
|---|---|---|---|---|---|---|---|---|---|
| b1 | b0 | P2 | P1 | P0 | a3 | a2 | a1 | a0 | k |
| 0 | 0 | — | — | — | 0 | 0 | 0 | 0 | 6 |
| 0 | 1 | 0 | — | — | 0 | 0 | 1 | 0 | 8 |
| 0 | 1 | 1 | — | — | 0 | 0 | 1 | 1 | 12 |
| 1 | 0 | 0 | 0 | — | 0 | 1 | 0 | 0 | 16 |
| 1 | 0 | 0 | 1 | — | 0 | 1 | 0 | 1 | 24 |
| 1 | 0 | 1 | 0 | — | 0 | 1 | 1 | 0 | 32 |
| 1 | 0 | 1 | 1 | — | 0 | 1 | 1 | 1 | 40 |
| 1 | 1 | 0 | 0 | 0 | 1 | 0 | 0 | 0 | 48 |
| 1 | 1 | 0 | 0 | 1 | 1 | 0 | 0 | 1 | 64 |
| 1 | 1 | 0 | 1 | 0 | 1 | 0 | 1 | 0 | 80 |
| 1 | 1 | 0 | 1 | 1 | 1 | 0 | 1 | 1 | 96 |
| 1 | 1 | 1 | 0 | 0 | 1 | 1 | 0 | 0 | 112 |
| 1 | 1 | 1 | 0 | 1 | 1 | 1 | 0 | 1 | 128 |
| 1 | 1 | 1 | 1 | 0 | 1 | 1 | 1 | 0 | 160 |
| 1 | 1 | 1 | 1 | 1 | 1 | 1 | 1 | 1 | 192 |

Figure 8:
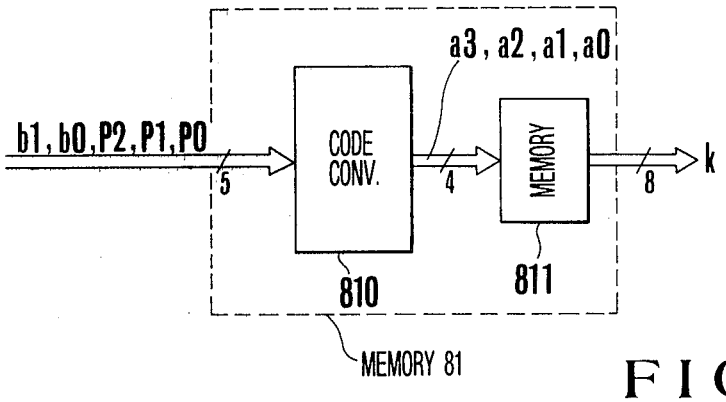
Figure 9:
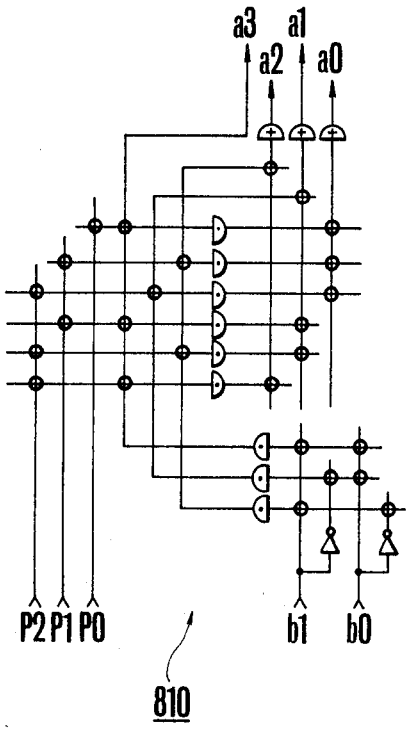

With the construction shown in FIG. 8, even when the code converter 810 is constituted by a read only memory device, the memory capacity of the code converter 810 may have only 128 bits ($2^5 \times 4$). In other words, a memory capacity of a total of 248 bits including the memory capacity of 120 bits (15×8) of the second memory device 811 is sufficient. Where the code converter 810 is constructed as a random logic circuit utilizing AND gate circuits, OR gate circuits and inverters as shown in FIG. 9 it is possible to further decrease the memory capacity, thus decreasing the size of the elements that produces the phase changing informations k.

Figure 10:
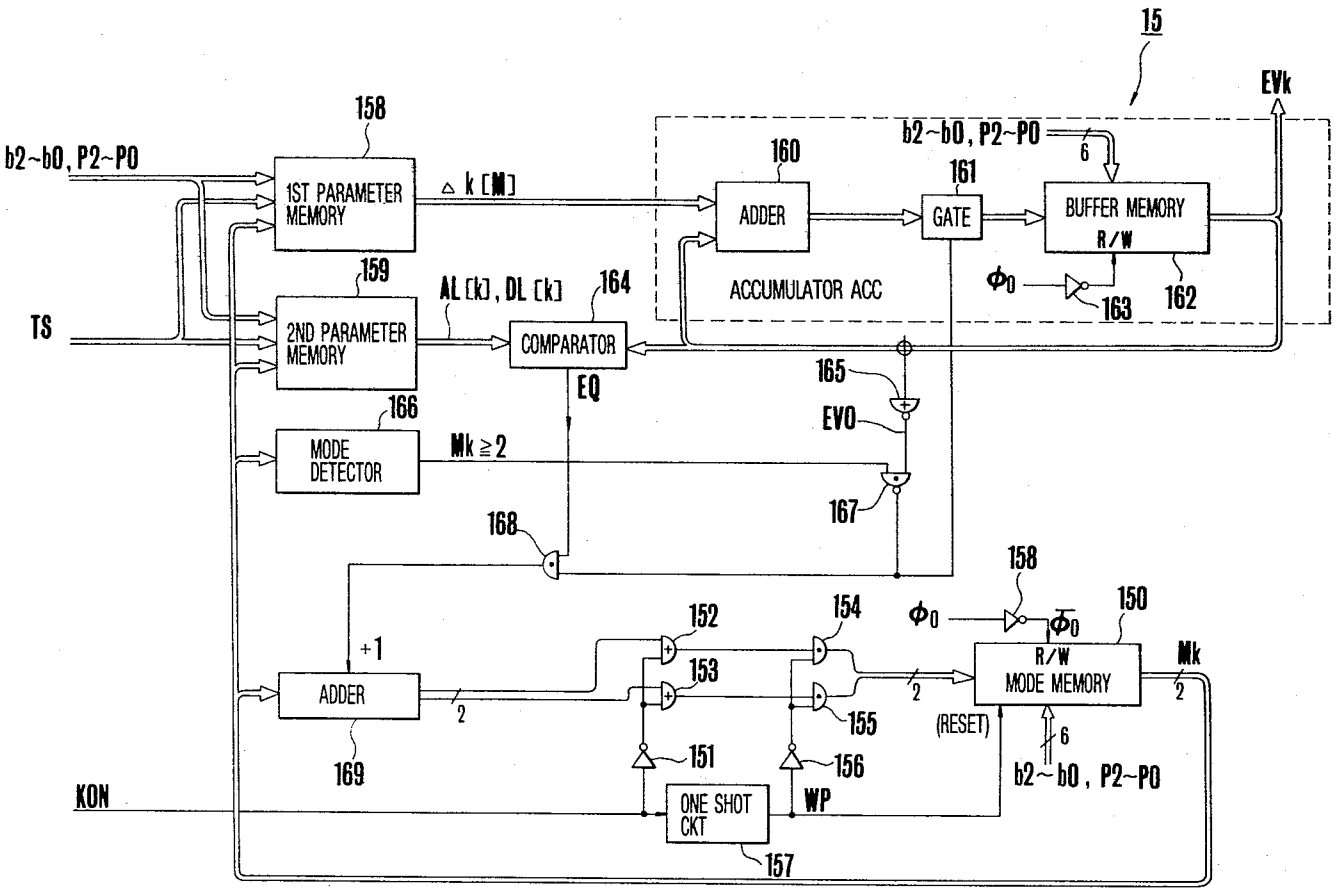
FIG. 10 is a connection diagram showing one example of the detail of an envelope generator.

FIG. 10 shows the detail of the envelope generator 15 which forms envelope signals EVk (Ev1 through EV192) for respective partial tone signals (h1 through h192w) shown in FIG. 5 and then outputs the signals thus formed in synchronism with the calculating timings of respective partial tone signals. As shown in FIG. 11*a*, each envelope signal EVk comprises four envelope segments of an attack, a first decay, a sustain, and a second decay. The envelope signal EVk made up of four segments is formed by sequentially accumulating an information Δk[M] (where M represents the types of the segments . . . in this embodiment "0" for the attack, "1", for the first decay, "2" for the sustain, and "3" for the second decay) representing an increment (at the time of the decay) or a decrement (at the time of the first decay, the sustain, and the second decay) of respective segments of a signal EVk applied to each partial tone signal. However, the shapes of the signals EVk are different dependent upon the tone color which corresponds to the tone color set by the tone color setter. For this reason, the information Δk[M], an attack level information AL[k] and a decay level information DL[k] are determined for each partial tone signal correspoding to the set tone color.

For example, the sequential accumulation operation of an increment informtion Δk[O] in an attack segment is executed until the accumulated value ΣΔk[0] of an information Δk[0] coincides with an attack level information Al[k] given to each partial tone signal corresponding to the set color.

The successive accumulation of the decrement information Δk[1] of the first decay segment (M="1" is executed until the difference AL [k]−ΣΔk[1] comes to coincide with the decay level information DL(k) of the signal EVk. The successive accumulation of the decrement information Δk(2) of the sustain segment (M=2) is executed until the key-on signal builds down, while the successive accumulation of the decrement information Δk(3) of the second decay segment (M=3) is continued until the difference between the sustain level SL(k) at the key-off point and the accumulated value ΣΔk(3) of Δk(3) (that is SL(k)−ΣΔk(3)) becomes "0".

In FIG. 10, a first parameter memory device 158 and a second parameter memory device 159 are provided with memory addresses that are designated by slot numbers b2 through b0, phase designation signals P2 through P0, color setting information TS and a segment information Mk representing a segment now being calculated and storing the increment informations Δk[M] regarding respective partial tone signals corresponding to set colors, an attack level information AL[k] and a decay level information DL[k]. A mode memory device 150 has memory addresses which are designated by slot number signals b2 through b0 and phase designation signals P2 through P0 and storing segment informations Mk representing the segments under calculation of the signals EVk regarding respective partial tone signals. At a key-off point, the segment informations of the signals EVk regarding respective partial tone signals are all "3" because the key-on signal KON becomes "0" when a depressed key is released which makes "1" the output of an inverter 151 with the result that the output signals of both OR gate circuits 152 and 153 become "1" which is applied to the mode memory device 150 via AND gate circuits 154 and 155 to act as a segment information of Mk=3 and written into the mode memory device 150 under the control of a clock signal $\overline{\phi 0}$ applied through an inverter 158.

Under this state, when the key-on signal KON becomes "1" as a result of key release, a one shot circuit 157 produces an one shot pulse WP having a narrow width as shown in FIG. 11*c* in synchronism with the build-up of the key-on signal KON. After being inverted by an inverter 156, this one shot pulse WP is applied to one inputs of AND gate circuits 154 and 155 as an inhibition signal. The one shot pulse WP is also applied to the mode memory device 150 to act as a reset signal of all stored informations. Accordings, segment informations Mk of 3 stored in all addresses are cleared or reset to Mk=0.

When the segment information outputted from the mode memoru device 150 becomes a state in which Mk=0, the first parameter memory device 158 and the second parameter memory device 159 produce, in synchronism with the calculating time slots of respective partial tone signals, the increment informations Δk[0] regarding the attack and the attack level informations AL(k) of each partial tone signal corresponding to a tone color set information Ts. The increment information Δk[0] regarding the attack of each partial tone signal is sequentially accumulated in each DAC cycle (see FIG. 5) by an accumulator ACC comprising an adder 160, a gate circuit 161, a buffer memory device 162 and an inverter 163.

Figure 11:
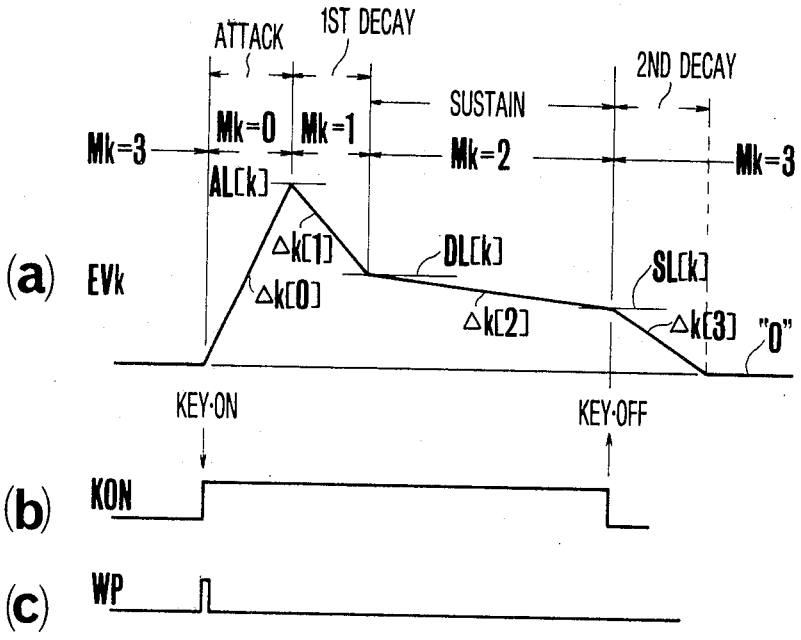
FIG. 11 shows one example of an envelope signal waveform.

More particularly the buffer memory device 162 has memory addresses of the number corresponding to the types of the partial tone signals (h1 through h192w) for storing accumulated values ΣΔk[M] of the informations Δk[M] in each DAC cycle so as to output the accumulated values ΣΔk[M] as the present amplitude values of the envelope signals. When an increment information Δk[0] regarding the attack of each partial tone signal is applied to one input of the adder 160, the increment information Δk[0] would be added to the accumulated value ΣΔk[0] of a corresponding partial tone signal read out from the buffer memory device 162 at this time to form a new accumulated value (ΣΔk[0]+Δk[0]) which is written into the buffer memory device 162 via the gate circuit 161. In this case, the accumulated values ΣΔk[0] regarding the attack of respective partial tone signals outputted from the buffer memory device 162 are all [0] in the early stage. Accordingly, after a key-on signal KON has been produced as a result of key depression, the accumulated value ΣΔk[0] regarding the attack of each partial tone signal gradually increases from a value of "0" as shown in FIG. 11, and the slope of the rise becomes steeper as the increment information Δk[0] increases.

As above described, the envelope signals regarding the segments of the attack are indepently formed for respective partial tone signals. But the accumulated value ΣΔk[0] for each partial tone signal is normally compared with the attack level information AL[k] of each partial tone signal by the comparator 164. When the result of comparison becomes ΣΔk[0]=AL[k], the comparator 164 would produce a coincidence signal EQ showing that the accumulated value ΣΔk[0] of a specific partial tone signal has reached the attack level. The coincidence signal EQ is applied to one input of the AND gate circuit 168, while the other input thereof is supplied with "1" because the segment information Mk is not equal to or larger than "2" (since the output of the NAND gate circuit 166 is "0", the output of the NAND gate circuit 167 is "1"). For this reason, the coincidence signal EQ passes through the AND gate circuit 168 and then applied to the "+1" input of the adder 169 so that it adds "+1" to the segment information Mk=0 regarding a partial tone signal in which ΣΔk[0]=AL[k]. This sum is applied to the information writing input terminal of the mode memory device 150 via OR gate circuits 152 and 153 and AND gate circuits 154 and 155, so that the segment information Mk stored in the mode memory device 150 and regarding a partial tone signal Mk in which ΣΔk[0] became equal to AL[k] would be updated to Mk=1. Thereafter the accumulation operation is executed based on the decrement information Δk[1] regarding the first decay segment.

More particularly, as the segment information Mk outputted from the mode memory device 150 is updated from Mk=0 to Mk=1, the first and second parameter memory devices 158 and 159 respectively produce a decrement information Δk[1](a negative value) regading the first decay segment and a decay level information DL[k]. Then in the accumulator 163 constituted by adder 160, gate circuit 161, buffer memory device 162 and inverter 163, the negative information Δk[1] is sequentially added at each DAC cycle to the accumulated value ΣΔk(0) (=AL[k]) when the attack level is reached the accumulated value ΣΔk[1] regarding the first decay segment decreases successively, and this successively decreasing accumulated value ΣΔk[1] is constantly compared with the decay level information DL(k) in the comparator 164. When the result of comparison becomes ΣΔk[1]=DL[k] the comparator 164 produces a coincidence signal EQ. At this time, since the segment information Mk is not equal to or larger than "2", the coincidence signal EQ outputted from the comparator 164 is applied to the adder 169 via the AND gate circuit 168 as a "+1" addition input. Consequently, the adder 69 adds "1" to the segment information Mk=1 regarding a partial tone signal in which ΣΔk[1]=DL[k]. The result of addition is applied to the information writing input terminal of the mode memory device 150 via the OR gate circuits 152, 153 and AND gate circuits 154, 155, whereby the segment information Mk stored in the mode memory device 150 and regarding a partial tone signal in which ΣΔk[1]=DL[k] would be updated to Mk=2. Thereafter the accumulation operation is executed based on a decrement information Δk[2] regarding the sustain segment.

More particularly, when the segment information Mk outputted from the mode memory device 150 is changed to Mk=2 from Mk=1, the first parameter memory device 158 would produce a decrement information Δk[2] (a negative value) regarding the sustain segment. Then, in the accumulator ACC, the negative decrement information ΔK[2] is sequentially added in each DAC cycle to the accumulated value τΔk[1] obtained when the first decay level DL[k] is reached, whereby the accumulated value ΣΔk[2] for the sustain segment decreases successively. During such accumulation operation, when the key-on signal KON becomes "0" as a result of key release, the inverter 151 applies a signal "1" to the OR gate circuits 152 and 153. Then, signals "1" outputted from the OR gate circuits 152 and 153 are applied to the information write input terminal of the mode memory device 150 via AND gate circuits 154 and 155. Thus, the segment information Mk would be updated from Mk=2 to Mk=3. Thereafter, the accumulation operation is executed based on the decrement information Δk[3] regarding the second decay segment.

Although this accumulation operation regarding the second decay segment is executed in the same manner as above described, this accumulation operation terminates when the accumulated value k[3] becomes "0".

More particularly, as the accumulated value ΣΔk[3] becomes "0", a detection signal EVO denoting this fact would be outputted from the NOR gate circuit 165. On the other hand, at this time, since the segment information Mk is equal to 3, the mode detector 166 outputs a signal "1" showing that Mk≧2. For this reason, the output signal of the NAND gate circuit 167 becomes "0" thus disabling the gate circuit 161 in the accumulator ACC, with the result that the accumulation operation regarding a partial tone signal in which ΣΔk[3]=0 is terminated.

Where the decrement information Δk[2] regarding the sustain segment has a large value, the accumulated value ΣΔk[2] may become "0" so that the key-on signal KON would not become "0". In such a case too, a signal "0" is supplied from the NAND gate circuit 167 to terminate the accumulation operation. In this case, the segment information Mk is updated to Mk=3 when the key-on signal KON becomes "0".

The accumulated values ΣΔk[0], ΣΔk[1], ΣΔk[2] and k[3] regarding respective segments of the attack, the first, the sustain and the second decays of respective partial tone signals formed in a manner as above described are outputted as envelope signals in synchronism with the calculating timings of respective partial tone signals, thus setting amplitudes of the envelope waveforms which are different for respective partial tone signals.

Figure 12:
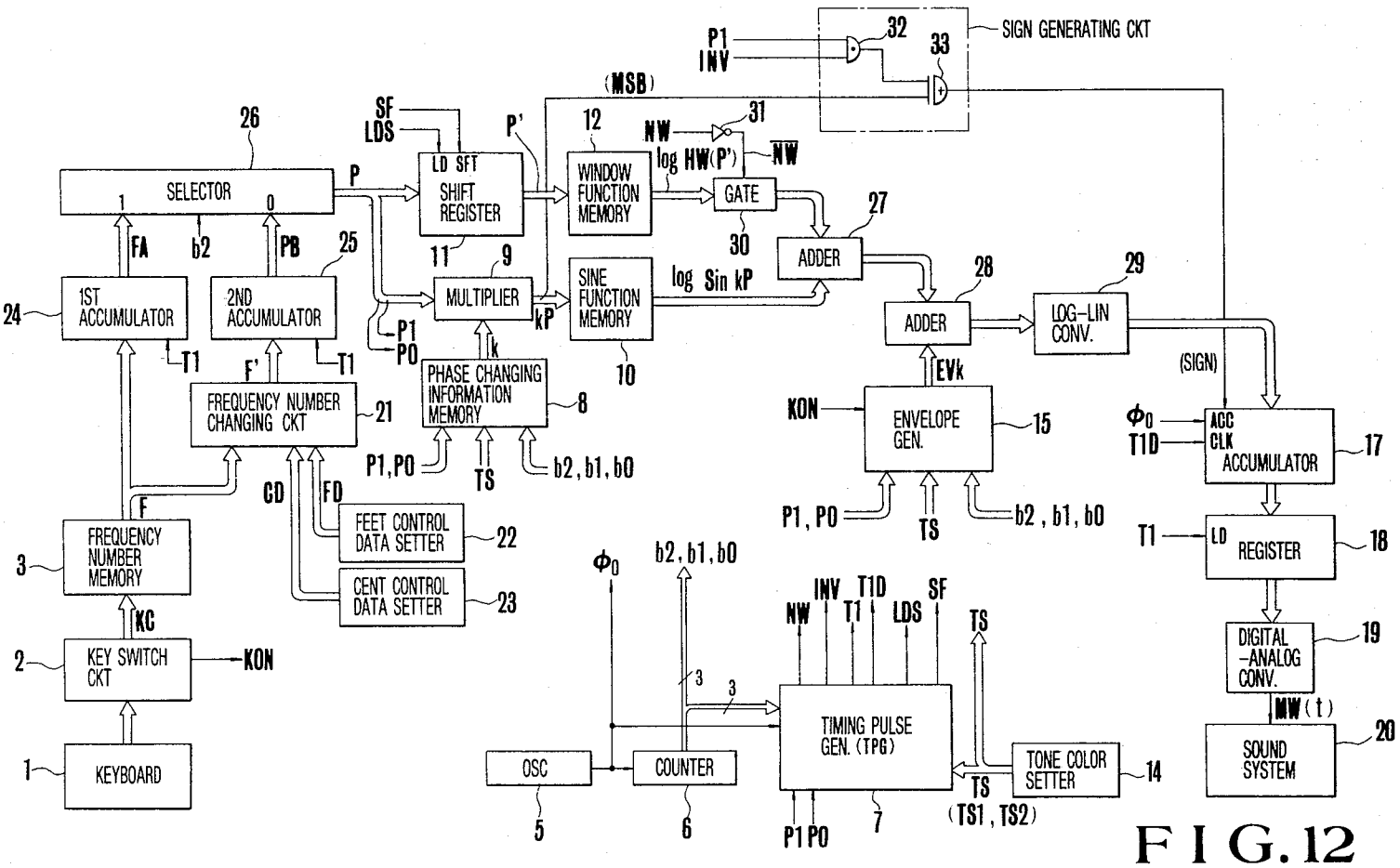
FIG. 12 is a block diagram showing another embodiment of the electronic musical instrument according to this invention.

FIG. 12 shows another embodiment of the electronic musical instrument according to this invention. Similar to the embodiment shown in FIG. 1, it comprises 8 time divisioned time slots ts0 through ts7 but in this modification these 8 time slots are divided into two groups, that is a first group ts0 through ts3 and a second group ts4 through ts7 for independently forming two musical tone signals having different tone pitches and tone colors.

Figure 13:
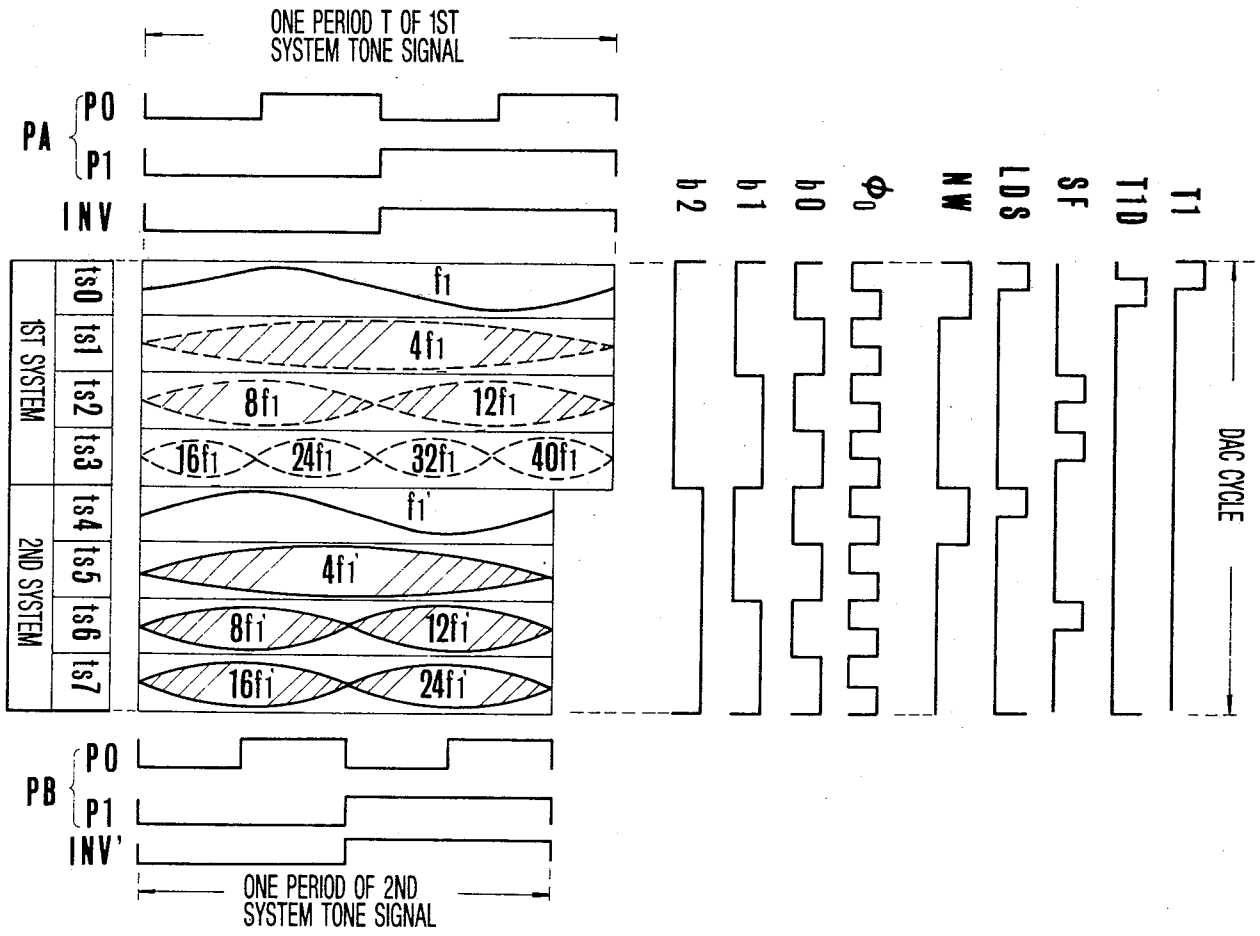
FIG. 13 is a graph showing the time relation between a partial tone signal formed by the electronic musical instrument shown in FIG. 12 and the timing pulse.

More particularly, in the first time slot groups ts0 through ts3 as shown in FIG. 13, a plurality of partial tone signals h12w having the 12th partial tone signal h12 as the center component are calculated by multiplying the 12th order partial tone signal of a frequency of 12fl with a Hanning window signal HW having a time width WT of (½)×(T). In the time slot ts3, one period T(1/fl) of the musical tone signal is divided into 4 intervals and in respective intervals, a Hanning window signal HW having a time width WT of (¼)×(T) is multiplied respectively with the 16th order, the 24th order, the 32th order and the 40th order partial tone signals h16, h24, h32 and h40 respectively having frequencies of 16fl, 24fl, 32fl and 40fl to form a plurality of partial tone signals h16w, h24w, h32w and 40w respectively the first order partial tone signal H1 having a frequency of fl is calculated. In the time slot ts0, in the time slot ts1, a plurality of partial tone signals h4w having the fourth order partial tone signal h4 as the center component are calculated by multiplying the fourth order partial tone signal h4 having a frequency of 4fl with a Hanning window signal HW having a time width WT of T(=1/fl), in the time slot ts2 and in the fore half of one period T(=1/fl) of the musical tone signal, a plurality of partial tone signals h8w having the 8th order partial tone signal h8 as the center component are calculated by multiplying the 8th order partial tone signal having a frequency of 8fl with a Hanning window signal HW having a time width WT of (½)×(T), whereas in the later half portion, having the 16th order partial tone signals h16, the 24th order partial tone signals h24, the 32th order partial tone signal h32 and the 40th order partial tone signal h40 as their center components.

In the second group time slots ts4 through ts7, the partial tone signals having frequencies as shown in the following Table V are multiplied with Hanning signals to caculate a plurality of partial tone components h4w', h8w', h12w' and h24w' having the first order partial tone signal h1 (of a frequency of fl') and the fourth order partial tone signal h4 (having a frequency of 4fl'), the 8th order partial tone signal h8 (having a frequency of 8fl'), the 12th order partial tone signal h12 (having a frequency of 12fl'), the 16th order partial tone signal h16 (having a frequency of 16fl') and the 24th order partial tone signal (having a frequency of 24fl') as their center components, where the frequency fl' is slightly different from the normal frequency fl of the fundamental wave corresponding to the tone pitch of a depressed key.

TABLE V

| time slot | | frequency of partial tone signal | time width WT of Hanning window signal HW, where T' = 1/f' | Partial tone signal to be calculated |
|---|---|---|---|---|
| ts 4 | | fl' | no window signal | h1' |
| ts 5 | | 4 fl' | (T') | h4w' |
| ts 6 | fore half | 8fl' | (½) × (T') | h8w' |
| | later half | 12 fl' | (½) × (T') | h12w' |
| ts 7 | fore half | 16 fl' | (½) × (T') | h16w' |
| | later half | 24 fl' | (½) × (T') | h24w' |

The partial tone signals calculated in the first group time slots ts0 through ts3 and the second group time slots ts4 through ts7 are synthesized at each one cycle of the time slots ts0 through ts7 (that is one DAC cycle) to be converted into an analogue synthesized musical tone signal. Consequently, with the electronic musical instrument of this embodiment it is possible to obtain a performance tone composed of two musical tones having slightly different tone pitches and different tone colors. In this case, the tone colors of the musical tone signals formed in respective groups are arbitrarily selected and since the tone pitch of the musical tone signal formed by the second group can be set to any value, performance tones rich in variety can be produced.

The construction of the circuit shown in FIG. 12 will now be described, in which elements corresponding those shown in FIG. 1 are designated by the same reference charactors.

In the same manner as in FIG. 1, a timing pulse generator 7 produces various timing pulses necessary to calculate various partial tone signals. In this embodiment, the timing pulse generator 7 generates timing pulses NW, INV, Tl, TID, LDS and SF. Of these, the timings of generations and the number of generations of the timing pulses NW, INV and SF are different depending upon the tone color set by the tone color setter 14. More particularly, the timing pulse NW becomes "1" when only one partial tone signal is calculated without using the Hanning window signal HW. Accordingly, when calculating only one partial tone signal with the time slot ts0 of the first group at a given set color, the timing pulse NW becomes "1" in the time slot ts0. The timing pulse becomes "1" in the later half portions of respective periods T and T' of the musical tone signal, where it is formed by eliminating even number ordered partial tone signals from the musical tone signals formed in respective groups, thus forming a musical tone signal made up of only the odd number ordered partial tone signals. For this reason, where a musical tone color made up of even number ordered partial tone signals and odd number ordered partial tone signals is selected, the timing pulse INV is always "0". It should be noted, however, that the timing signal may be different in the first and second groups.

The timing pulse SF corresponds to the timing pulse T4 shown in FIG. 1 and is used to generate Hanning window signals having time widths NT of $(\frac{1}{2})\times(T)$ and $(\frac{1}{4})\times(T)$ (in the second group T=T') by shifting respective bits of the phase designation signal P loaded in the shift register 11. Consequently, the timing of generation and the number of generations of this timing pulse SF are different depending upon the assignment of respective partial tone signals to be calculated in respective time slots and the time width WT of the Hanning window signal HW. The timing pulse LDS is used to load the phase designation signals PA and PB for different groups in the shift register 11.

A frequency number changing circuit 21 is provided for the purpose of changing the frequency number F outputted from the frequency number memory device 3 in accordance with a feet data FD set by a feet control data setter 22 and a cent data CD set by a cent control data setter 23, for outputting the frequency number F as a frequency number F' which is accumulated in an accumulator 25 of the second group with the period of generation of the timing pulse T1. The feet data FD and the cent data CD are used to vary the pitch of a musical tone formed in the second group with respect to the musical tone formed in the first group. The accumulated value qF' (q=1, 2 . . . ) obtainable in an accumulator in the second group is applied to a selector 26 as a phase designation signal PB that designates the sampling point phase of one period T' of the musical tone signal formed in the second group and is selectively outputted from the selector 26 in a range of time slots ts1 through ts7 in which the slot number signal becomes "1".

The frequency number F corresponding to the tone pitch of the depressed key is accumulated in the accumulator 24 of the first group at each period of generation of the timing pulse T1 and the accumulated value qF is applied to the selector 26 as a phase designation signal PA that designates the sampling points of one period T of the musical tone signal generated by the first group. The accumulated value qF is selectively outputted from the selector 26 in a range of the time slots ts0 through ts7 in which the slot number signal b2 is "0". In this case, the recurrent frequencies of the phase designation signals PA and PB of the first and second grous coincide with the frequencies fl and fl' of the musical tone signals to be formed in respective groups.

In the same manner as that shown in FIG. 1, the phase changing information memory device 8 changes the phase designation signals P (PA and PB) according to the frequencies of the partial tone signals to be calculated in respective time slots ts0 through ts7, but the phase changing information memory device 8 of this embodiment is constructed such that it produces different phase changing informations k for the first and second groups according to tone colors set therefore. The phase changing memory device 8 utilized in this embodiment has n memory blocks MB1 through MBn corresponding to n types of the set tone colors that can be set by the tone color setting information TS. An address k of each memory block, which is designated by most significant bit P1 and the next order bit P0 of the phase designation signal P(PA, PB), and by the slot number information b2, b1 and b0 stores a phase changing information k corresponding to a set tone color. Accordingly, when the tone color setting information TS the upper order two bit signals P1 and P0 of the phase designation signal P and slot number signals b2 through b1 are applied to the phase changing information memory device 8 as an address signal, a phase changing information k corresponding to the tone color setting information Ts would be produced at a phase position in one period of a musical tone signal designated by the bits P1 and P0 in each time slot of each group.

Accordingly, where the phase designation signal P(PA, PB) outputted from the selector 26 in accordance with phase changing information k corresponding to a set tone color of each group is changed (by multiplication) with a multiplier 9 and when the phase designation signal kP (partial tone phase designation signal) thus changed is applied to a sine function memory device 10 to act as an address signal, the sine function memory device 10 would produce a partial tone signal sink kP of a frequency corresponding to the signal kP. In this embodiment, since the multiplication operation is executed at a high speed, the sine amplitude values at respective sampling points of one period of the sine waveform stored in the sine function memory device are expressed in terms of logarithmic sine amplitude values log sin P. For this reason, where a partial tone phase designation signal kP is given, a logarithmic sine amplitude value log sin kP would be outputted.

In the same manner as in FIG. 1, a shift register 11 operates to change the phase designation signals P (PA, PB) according to the time widths WT of the Hanning window signals assigned to respective time slots ts0 through ts7 for applying the window phase designation signals P' thus changed to the window function memory device 12 as address signals. However, as already has been pointed out, the timing of generation and the number of generations of the timing pulse SF which shifts respective bits of the phase designation signal loaded in the shift register 11 in the first time slots ts0 and ts4 of the first and second groups towards upper bits are different. Accordingly, window phase designation signals P' corresponding to the set tone colors are outputted from the shift register 11 in respective time slots ts0 through ts7. At this time, in the window function memory device 12 are stored logarithmic window signal amplitude value at respective sampling points of the Hanning window signal HW. Thus, the window function memory device 12 outputs logarithmic window signal amplitude value log HW (P'). Consequently, when the logarithmic sine amplitude value log sin kP is multiplied with the logarithmic Hanning window signal amplitude value log HW (P') in the multiplier 27 and then the product thus produced is multiplied with an envelope signal EVk in the multiplier 28 to apply an envelope. Then the output of the multiplier 28 is converted into a natural number by a logarithm—linear converter 29. With this construction, it is possible to produce respective partial tone signals in the same manner as in FIG. 1 utilizing multipliers 13 and 16. Where a single partial tone signal is to be calculated in a given time slot, for example the time slot ts0 of the first group or the time slot ts4 of the second group shown in FIG. 13, a gate circuit 30 interposed between the window function memory device 12 and the multiplier 27 is disabled by a signal $\overline{NW}$ obtained by inverting the timing pulse NW with an inverter 31. At this time, a Hanning window signal HW (log HW(P')=0) is applied to the adder 27.

The partial tone signals calculated in this manner are synthesized in the accumulator 17 in each DAC cycle and then transferred to the register 18. In this embodiment, however, for synthesizing the partial tone signals in each DAC cycle, there is provided a circuit designating the fact that the polarities of the partial tone signals calculated in the later half portions in one periods of the musical tone signals produced in the first and second groups should be inverted and then synthesized. More particularly, this circuit comprises an AND gate circuit 32 and an exclusive OR gate circuit 33 bounded by dot and dash lines shown in FIG. 12. This circuit inverts the most significant bit signal of the partial tone phase designation signal kP outputted from the multiplier 9 and then applies the inverted signal b0 a code bit input of the accumulator 17 when the timing pulse INV is "1" in the later half portions of one periods of the musical tone signals produced in respective groups. Thus, the accumulator 17 synthesizes partial tone signals with their polarities inverted. Where one period of a musical tone signal of each group is considered continuously, a musical tone signal is produced from which only the even number ordered components are eliminated thus containing only the odd number ordered components. Where the signal INV is "0" in the normal fore and later half portions (that is not inverted), to the code input of the accumulator 17 is inputted the most significant bit of the signal kP as it is.

Figure 14:
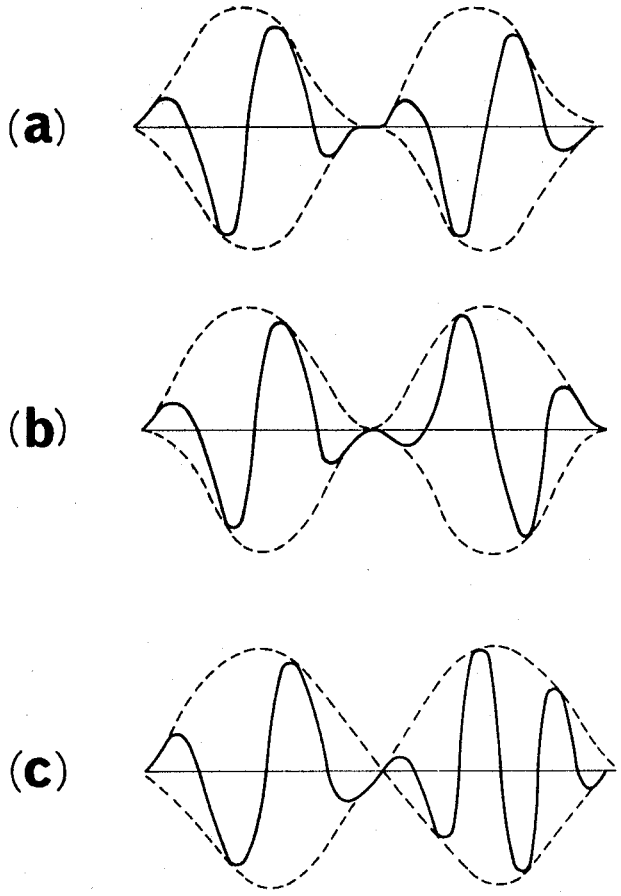
FIG. 14 shows waveforms useful to explain the principle of a circuit used to eliminate even number ordered components.

For example, a musical tone signal waveform which is symmetrical in the fore and later half portions of one period of a musical tone signal as shown in FIG. 14*a* contains both the even and odd number ordered components. When the polarity of the later half waveform is inverted, the resulting musical tone signal waveform would be as shown in FIG. 14*b*, that is a symmetrical musical tone signal waveform. The fore half portion of one period of the symmetrical musical tone signal waveform is generally expressed by $$\Sigma An \sin n\ wt \qquad (1)$$

while the later half portion is generally expressed by $$\begin{aligned} &-\Sigma An \sin (n\ wt - n\pi) \qquad (2)\\ &= -\Sigma An (\sin n\ wt \times \cos n\pi - \cos n\ wt \times \sin n\pi)\\ &= -\Sigma An (\sin n\ wt \times (-1)^n)\\ &= \Sigma(-1)^{n+1} \times An \sin n\ wt \end{aligned}$$

By synthesizing equations (1) and (2) we obtain $$\begin{aligned} \Sigma An \sin n\ wt + \Sigma(-1)^{n+1} \times An \sin n\ wt = {} & A1 \sin wt + \\ & A2 \sin 2wt + A3 \sin 3wt + A4 \sin 4\ wt + A5 \sin 5\ wt \ldots + \\ & A1 \sin wt - A2 \sin 2wt + A3 \sin 3wt - A1 \sin 4wt + A5 \sin 5wt \end{aligned}$$

in which all terms representing even nunber ordered components are eliminated so that finally expressed by $$2[A1 \sin wt + A3 \sin 3wt + A5 \sin 5wt \ldots] \qquad (3)$$

Consequently, the musical tone signal waveform as shown in FIG. 14*b* is eliminated its all even number ordered components so that it would contain only the odd number ordered components. In this case, as shown in FIG. 14*c*, even when the musical tone waveform is not perfectly symmetrical in the fore and later half portions of one period of the musical tone, when even number ordered components present in both half portions, the even number ordered components would be suppressed by inverting the sine of the component in the later half portion. This measure is extremely efficient when a musical tone of a wind instrument such as a clarinet is to be formed.

The electronic musical instrument shown in FIG. 12 operates as follows.

After closing a source switch, not shown, the counter 6 and the timing pulse generator 7 produce slot number signals b2, b1 and b0 and timing pulse signals T1 and T1D. Under these states, when desired tone colors are set for respective groups with the tone color setter 14 the timing pulse generator 7 would generate timing pulse NW, LDS, SF and INV shown in FIG. 13 corresponding to the tone color set for the two groups. After setting desired feet data FD and cent data CD with the feet control data setter 22 and the cent control data setter 23, when a key of a keyboard 1 is depressed, a frequency number F corresponding to the tone pitch of the depressed key is read out from the frequency number memory device 3, the frequency number F being applied to the first group accumulator 24 as it is, and converted by the frequency number changing circuit 21 into a frequency number F' slightly different from the depressed key tone pitch according to the feet data FD and the cent data CD and then supplied to the second group accumulator 25. This second group accumulator 25 sequentially accumulates the frequency number F' at the time of generating the timing pulse T1, the recurrent frequency of accumulation being selected such that an accumulated value qF' having the same frequency fl' as that of the musical tone signal to be formed in the second group would be outputted as the phase disignation signal PR for the second group.

On the other hand, the first goup accumulator 24 sequentially accumulates the frequency number F corresponding to the tone pitch of the depressed key at the time of generating the timing pulst T1 for producing an accumulated value qF having a recurrent frequency fl same as that of the musical tone signal to be formed in the first group, the accumulated value qF being used as a phase designation signal PA for the first group. These phase designation signals DA and PB for the first and second groups are selected by the slot number signal b2 and outputted, on the time division basis, from the fore and later half portions of 8 time slots ts0 through ts7. More particularly, in the time slots ts0 through ts3 the phase designation signal PA regarding the first group is outputted from the selector 26 as a signal P, whereas in the time slots ts4 through ts7, the phase designation signal PB regarding the second group is outputted from the selector 26 as the signal P which is changed in the multiplier 9 and the shift register 11 in accordance with the frequencies of the partial tone signals to be calculated in respective time slots ts0 through ts7.

More particularly, even when the partial tone signals to be calculated in respective time slots ts0 through ts7 are assigned as shown in FIG. 13, the phase changing information memory device 8 produces phase changing informations k as shown in the following Table VI at the phase positions of one period of the musical tone signal designated by the upper order 2 bit signals of the phase designation signals P and in the time slots designated by the slot number signals b2, b1 and b0. This phase changing information k is applied to the multiplier 9. Thus, the recurrent frequency of the phase designation signal P produced by the selector 26 changes to coincide with the frequencies of the partial tone signals to be calculated in respective time slots ts0 through ts7.

TABLE VI

| | phase | | time slot | | | | phase changing |
|---|---|---|---|---|---|---|---|
| | P1 | P0 | b2 | b1 | b0 | ts | information |
| first | 0 | 0 | 0 | 0 | 0 | ts 0 | k = 1 |
| group | | | 0 | 0 | 1 | 1 | = 4 |
| | | | 0 | 1 | 0 | 2 | = 8 |
| | | | 0 | 1 | 1 | 3 | = 16 |
| second | | | 1 | 0 | 0 | 4 | = 1 |
| group | | | 1 | 0 | 1 | 5 | = 4 |
| | | | 1 | 1 | 0 | 6 | = 8 |
| | | | 1 | 1 | 1 | 7 | = 16 |
| first | 0 | 1 | 0 | 0 | 0 | ts 0 | k = 1 |
| group | | | 0 | 0 | 1 | 1 | = 4 |
| | | | 0 | 1 | 0 | 2 | = 8 |
| | | | 0 | 1 | 1 | 3 | = 24 |
| second | | | 1 | 0 | 0 | 4 | = 1 |
| group | | | 1 | 0 | 1 | 5 | = 4 |
| | | | 1 | 1 | 0 | 6 | = 8 |
| | | | 1 | 1 | 1 | 7 | = 16 |
| first | 0 | 0 | 0 | 0 | 0 | ts 0 | k = 1 |
| group | | | 0 | 0 | 1 | 1 | = 4 |
| | | | 0 | 1 | 0 | 2 | = 12 |
| | | | 0 | 1 | 1 | 3 | = 32 |
| second | | | 1 | 0 | 0 | 4 | = 1 |
| group | | | 1 | 0 | 1 | 5 | = 4 |
| | | | 1 | 1 | 0 | 6 | = 12 |
| | | | 1 | 1 | 1 | 7 | = 24 |
| first | 1 | 1 | 0 | 0 | 0 | ts 0 | k = 1 |
| group | | | 0 | 0 | 1 | 1 | = 4 |
| | | | 0 | 1 | 0 | 2 | = 12 |
| | | | 0 | 1 | 1 | 3 | = 40 |
| second | | | 1 | 0 | 0 | 4 | = 1 |
| group | | | 1 | 0 | 1 | 5 | = 4 |
| | | | 1 | 1 | 0 | 6 | = 12 |
| | | | 1 | 1 | 1 | 7 | = 24 |

By applying the partial tone designation signals outputted from the multiplier 9 to the sine function memory device 10 to act as address signals, sine wave amplitude values log sin kP having frequencies as shown in the following Table VII are read out from the sine function memory device.

TABLE VII

| | time slot | | frequency of log sin kP |
|---|---|---|---|
| first | ts 0 | | f1 |
| group | ts 1 | | 4 f1 |
| | ts 2 | P1 = 0 | 8 f1 |
| | | P1 = 1 | 12 f1 |
| | ts 3 | P1,P0 = 0,0 | 16 f1 |
| | | = 0',1 | 24 f1 |
| | | = 1,0 | 32 f1 |
| | | = 1,1 | 40 f1 |
| second | ts 4 | | f1' |
| group | ts 5 | | 4 f1' |
| | ts 6 | P1 = 0 | 8 f1' |
| | | = 1 | 12 f1' |
| | ts 7 | P1 = 0 | 16 f1' |
| | | = 1 | 24 f1' |

The phase designation signals P outputted from the selector 26 are loaded in the shift register 11 at the time of generating the timing pulses LDS for the first and second groups and the loaded phase designation signals are shifted towards the upper order bits each time a timing pulse SF is generated to produce window phase designation signals P' having periods corresponding to the time widths WT of the Hanning window signals HW assigned to respective time slots.

Consequently, Hanning window signal amplitude values log HW (P') having time widths as shown in the following Table VIII are read out from the window function memory device 12.

TABLE VIII

| | time slot | | time width WT of log HW (P') |
|---|---|---|---|
| first | ts 1 | | T |
| group | ts 2 | P1 = 0 | ½ T |
| | | = 1 | " |
| | ts 3 | P1,P0 = 0,0 | ¼ T |
| | | = 0,1 | " |
| | | = 1,0 | " |
| | | = 1,0 | " |
| second | ts 4 | | T' |
| group | ts 5 | | T' |
| | ts 6 | P1 = 0 | ½ T'' |
| | | = 1 | " |
| | ts 7 | P1 = 0 | ½ T' |
| | | = 1 | " |

As above described, the sine amplitude value log sin kP read out from the sine function memory device 10 is multiplied with the window signal amplitude value log HW(P') outputted from the window function memory device 12 in the adder 27, with regard to the same time slot. In the example shown in FIG. 13, since the timing pulse NW is "1" in the time slot so of the first group and in the time slot ts4 of the second group, the adder 27 is supplied with a window signal amplitude value of log HW(P')=0. For this reason, in the time slots ts0 and ts4, the sine amplitude value log sin kP is outputted from the adder 27 as the partial tone signals h1 and h1', while in the other time slots, the sine amplitude value log sin kP is multiplied with the window signal amplitude value log HW(P') for producing many partial tone signals h4w, h8w, h12w, h16w, h24w, h32w, h40w, h4w', h8w', h12w', h16w' and h24w' over a predetermined bandwidth having a frequency represented by kP as its center component.

The partial tone signals of the first and second groups calculated as above described are independently imparted with amplitude envelopes by the multiplier 28 and then synthesized by the accumulator 17 at each DAC cycle. Then the synthesized signals are transferred to the register 18, converted into an analogue synthesized musical tone signal MW'(t) by a digital-analogue converter 19 and produced as a musical tone through the second system 20.

In this case, the frequency of the musical tone signal formed in the first group (obtained by synthesizing partial tone signals calculated in the time slots ts0 through ts3) is different from that of the musical tone signal formed in the second group (obtained by synthesizing the partial tone signals calculted in time slots ts4 through ts7) and their constituent components are also different. Thus, in this embodiment it is possible to produce a performance tone which looks as if two electronic musical instruments of different tone colors were performed simultaneously.

In this embodiment it is also possible to make the same the pitches of the musical tone signals formed in the first and second groups but to make different the tone colors and vice versa. Although in the foregoing embodiments the sine wave signals (sin kP and log sin kP) and Hanning window signals [HW(P') and log HW(P')] were prestored in a memory device thses signals may be produced during performance.

Furthermore, although the time width HW of the Hanning window signal HW was controlled by changing the period of the phase designation signal with a shift register, the period can also be controlled by applying a phase changing information in the same manner as in the case of changing the frequency of the partial tone signal.

The time window signal is not limited to the Hanning window signal but may be a square wave window, a Hanning window, a Gaussian window or a Dolph Chebyshev window signal.

The frequencies of the partial tone signals to be calculated are not required to have a perfect integer ratio but may be slightly deviated therefrom in which case a nonharmonic musical tone signal is obtained. To this end the phase changing information k is set to be slightly different from an integer, for example k=2.001. Of course the number of the time slots for calculating partial tone signals may be increased or decreased from 8.

What is claimed is:

1. An electronic musical instrument comprising:
means for producing a time window signal;
means for producing a plurality of predetermined partial tone signals;
first control means connected to said time window signal producing means for controlling a time width of said time window signal;
second control means connected to said partial tone signal producing means for controlling the frequency of each of said partial tone signals and assigning said partial tone signals to respective time divisioned time slots;
modulating means for modulating said partial tone signals with said time window signal and producing modulated partial tone signals in said time divisioned time slots respectively; and
synthesizing means connected to said modulating means for synthesizing said modulated partial tone signals and producing a musical tone signal.

2. An electronic musical instrument according to claim 1 which further comprises keyboard means having a plurality of keys and circuit means for producing a key signal corresponding to a depressed key among said keys and supplying said key signal to said second control means, said frequency of each of said partial tone signal corresponding to said key signal.

3. An electronic musical instrument comprising:
means for producing a plurality of time window signals;
means for producing a plurality of predetermined partial tone signals;
first control means connected to said time window signal producing means for controlling a time width of each of said time window signals and assigning said time window signals to respective time divisioned time slots, second control means connected to said partial tone signal producing means for controlling the frequency of each of said partial tone signals and assigning said partial tone signals to respective said time divisioned time slots;
modulating means for modulating said partial tone signals with said time window signals and producing modulated partial tone signals in said time divisioned time slots respectively; and
synthesizing means connected to said modulating means for synthesizing said modulated partial tone signals and producing a musical tone signal.

4. An electronic musical instrument according to claim 1 wherein said time window signal producing means comprises a first function memory device storing a predetermined window function, said partial tone signal producing means comprises a second function memory device storing a sine or cosine function, said first control means comprises a first signal converter which applies first address signal to said first function memory device in accordance with a frequency of a partial tone signal in each time divisioned time slot, and said second control means comprises a second signal converter which applies a second address signal to said second function memory device in accordance with the frequency of the partial tone signal in each time divisioned time slot.

5. An electronic musical instrument according to claim 1 wherein portions of a partial tone signal to be calculated in a predetermined one or more of said time divisioned time slots are made to be different in a plurality of sections formed by dividing one period of a musical tone signal to be produced so as to calculate different partial tone signals on the time division basis.

6. An electronic musical instrument according to claim 5 wherein, for each of said predetermined one or more time divisioned time slots, (a) said second control means controls said partial tone signal so as to have different frequencies in said portions corresponding to different sections of a period of said musical tone signal, and (b) said first control means controls said time window signals so as to have the same time width for each respective one of said portions corresponding to said different sections of a period.

7. An electronic musical instrument comprising a plurality of musical tone forming channels, each of which comprises:
means for producing a plurality of time window signals;
means for producing a plurality of predetermined partial tone signals;
first control means connected to said time window signals producing means for controlling a time width of each of said time window signals and assigning said time window signals to respective time divisioned time slots;

second control means connected to said partial tone signal producing means for determining the frequency of each of said partial tone signals and assigning said partial tone signals to respective said time divisioned time slots;

modulating means for modulating said partial tone signals with said time window signals and producing modulated partial tone signals in said time divisioned time slots respectively; and synthesizing means connected to said modulating means for synthesizing said modulated partial tone signals on the time division basis, musical tones in respective said musical tone forming channels being different each other.

8. An electronic musical instrument according to claim 7 wherein each of said musical tone forming channels comprises a time divisioned musical tone forming channels which forms discrete musical tone signals in a plurality of time divisioned time slots.

* * * * *